US009555916B2

(12) United States Patent
Abayhan et al.

(10) Patent No.: US 9,555,916 B2
(45) Date of Patent: Jan. 31, 2017

(54) PAPERBOARD CONTAINER HAVING INCREASED RIGIDITY AND METHOD OF MANUFACTURING THEREOF

(75) Inventors: Ayberk Abayhan, Lake Bluff, IL (US); Stephen A. Smith, Naperville, IL (US); Robert J. Schaefer, Baltimore, MD (US)

(73) Assignee: SOLO CUP OPERATING CORPORATION, Chicago, IL (US)

( * ) Notice: Subject to any disclaimer, the term of this patent is extended or adjusted under 35 U.S.C. 154(b) by 1482 days.

(21) Appl. No.: 11/622,952

(22) Filed: Jan. 12, 2007

(65) Prior Publication Data

US 2007/0235514 A1 Oct. 11, 2007

Related U.S. Application Data

(60) Provisional application No. 60/758,953, filed on Jan. 13, 2006.

(51) Int. Cl.

| | |
|---|---|
| ***B65D 1/34*** | (2006.01) |
| ***A47G 19/03*** | (2006.01) |
| ***B31B 45/00*** | (2006.01) |
| ***B65D 1/44*** | (2006.01) |

(52) U.S. Cl.

CPC ..... *B65D 1/34* (2013.01); *A47G 19/03* (2013.01); *B31B 45/00* (2013.01); *B65D 1/44* (2013.01); *B31B 2201/223* (2013.01); *B31B 2201/2654* (2013.01); *B31B 2201/2695* (2013.01); *B31B 2203/062* (2013.01); *B31B 2203/064* (2013.01)

(58) Field of Classification Search

USPC ..... 229/407

See application file for complete search history.

(56) References Cited

U.S. PATENT DOCUMENTS

| | | | | |
|---|---|---|---|---|
| 2,215,698 | A | | 9/1940 | Harvey |
| 2,489,507 | A | | 11/1949 | Shapiro et al. |
| 3,315,018 | A | | 4/1967 | Commeyras |
| 3,672,538 | A | * | 6/1972 | Wiedemann ..... 206/519 |
| 3,720,365 | A | * | 3/1973 | Unger ..... 229/406 |
| 4,606,496 | A | | 8/1986 | Marx et al. |
| 4,609,140 | A | | 9/1986 | Van Handel et al. |
| 4,721,499 | A | | 1/1988 | Marx et al. |
| 4,721,500 | A | | 1/1988 | Van Handel et al. |
| 5,088,640 | A | | 2/1992 | Littlejohn |
| 5,230,939 | A | * | 7/1993 | Baum ..... 428/84 |
| 5,326,020 | A | | 7/1994 | Cheshire et al. |
| 5,938,112 | A | * | 8/1999 | Sandstrom ..... 229/407 |
| 6,186,394 | B1 | | 2/2001 | Dees et al. |
| 6,440,509 | B1 | | 8/2002 | Littlejohn et al. |
| 6,491,214 | B2 | | 12/2002 | Plummer et al. |
| 6,571,980 | B2 | | 6/2003 | Littlejohn et al. |
| 6,715,630 | B2 | | 4/2004 | Littlejohn et al. |

(Continued)

*Primary Examiner* — Christopher Demeree

(74) *Attorney, Agent, or Firm* — Bradley F. Rademaker; Neal, Gerber & Eisenberg LLP

(57) ABSTRACT

The invention relates to pressed paperboard containers, such as disposable paper plates and bowls, having increased strength and rigidity, and the processes used to form such containers by the formation of non-radial pleats at outer regions of the container. The invention also provides pleats about the outer periphery that are non-linear along the length of the pleat. Such non-radial and non-linear pleats are formed by forming non-radial and non-linear scores in a blank of paperboard converted into the container geometry.

45 Claims, 14 Drawing Sheets

(56) References Cited

U.S. PATENT DOCUMENTS

| | | | | |
|---|---|---|---|---|
| 6,740,373 | B1 | 5/2004 | Swoboda et al. | |
| 6,893,693 | B2 | 5/2005 | Swoboda et al. | |
| 6,919,111 | B2 | 7/2005 | Swoboda et al. | |
| 6,932,753 | B1 | 8/2005 | Smith et al. | |
| 7,048,176 | B2 | 5/2006 | Littlejohn et al. | |
| 7,121,422 | B2 | 10/2006 | Gitschlag et al. | |
| 2002/0113118 | A1 | 8/2002 | Littlejohn et al. | |
| 2002/0179612 | A1* | 12/2002 | Toussant | 220/574 |
| 2004/0069788 | A1 | 4/2004 | Johns et al. | |
| 2004/0185200 | A1 | 9/2004 | Neculescu et al. | |
| 2005/0112305 | A1 | 5/2005 | Swoboda et al. | |
| 2006/0057365 | A1 | 3/2006 | Swoboda et al. | |
| 2006/0208054 | A1 | 9/2006 | Littlejohn et al. | |

* cited by examiner

FIG. 13
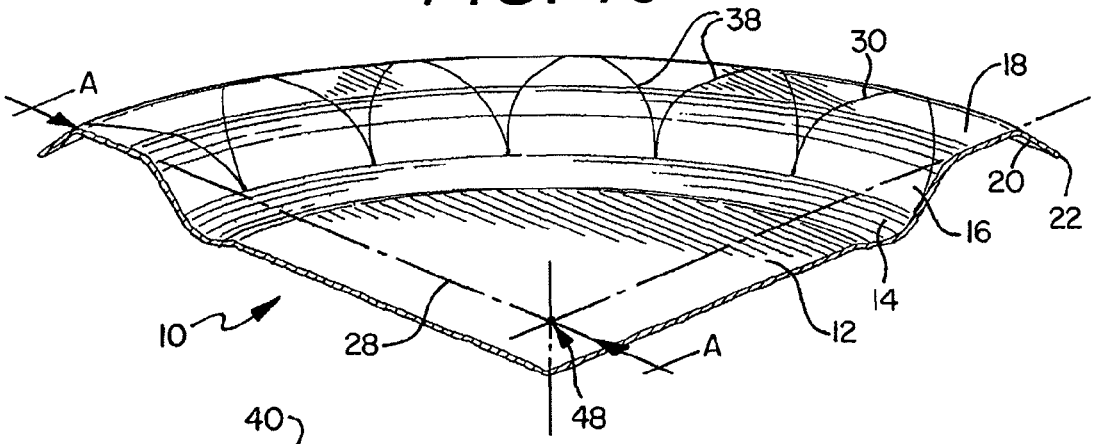
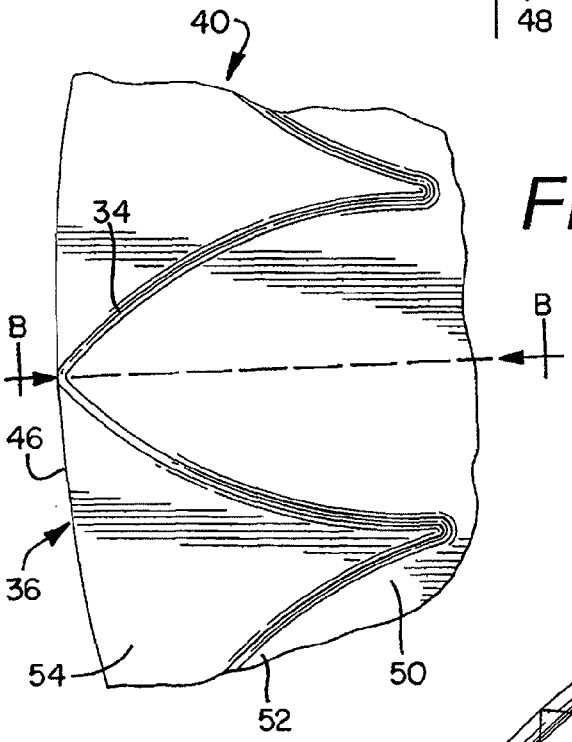
FIG. 14
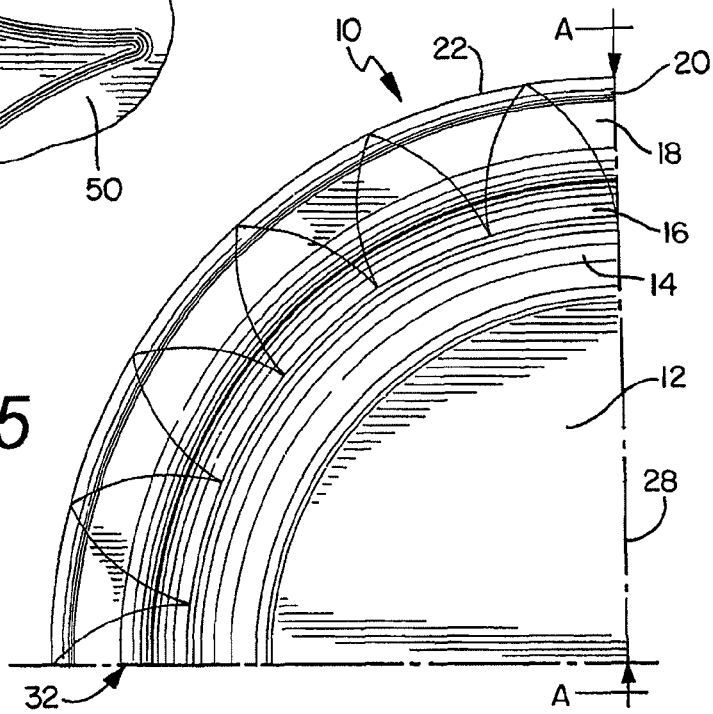
FIG. 15

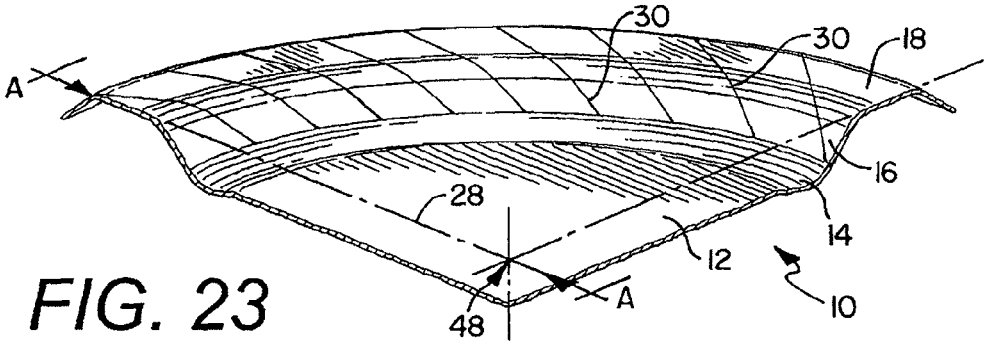
FIG. 23
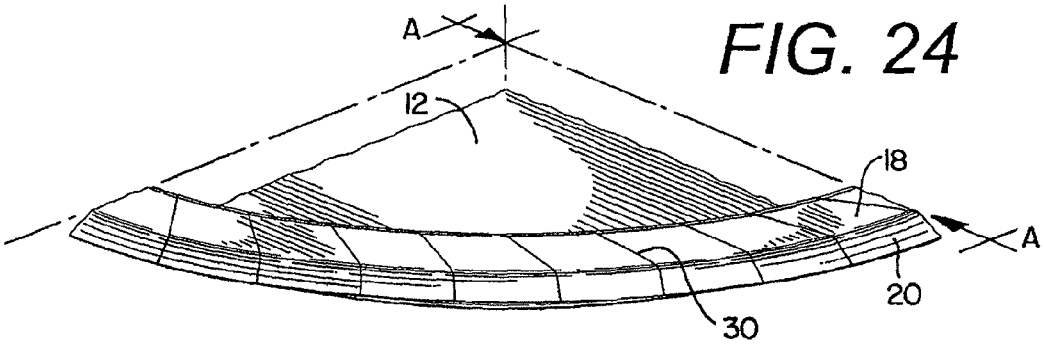
FIG. 24
FIG. 25
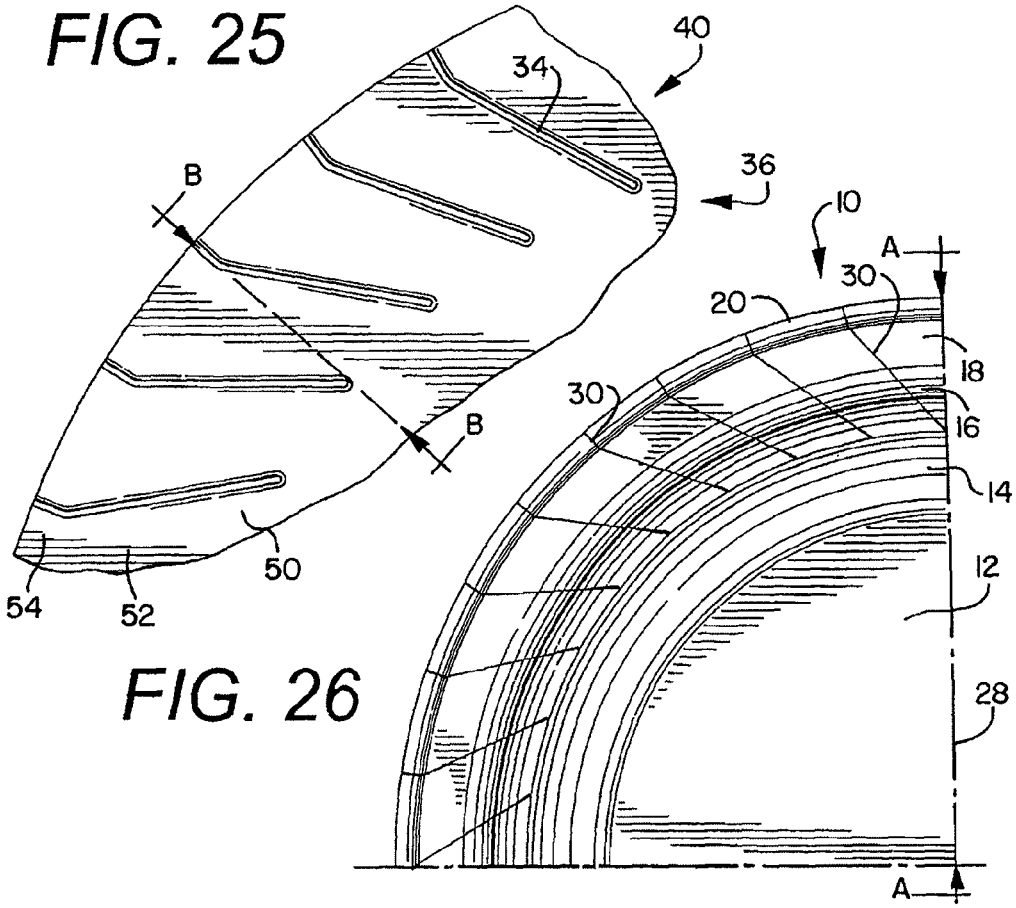
FIG. 26

PAPERBOARD CONTAINER HAVING INCREASED RIGIDITY AND METHOD OF MANUFACTURING THEREOF

CROSS-REFERENCE TO RELATED APPLICATIONS

This application claims the benefit of U.S. Provisional Patent Application No. 60/758,953, filed Jan. 13, 2006, which is expressly incorporated herein by reference and made a part hereof.

TECHNICAL FIELD

The invention relates to pressed paperboard containers, such as disposable paper plates and bowls, having increased strength and rigidity, and the processes used to form such containers.

BACKGROUND OF THE INVENTION

Pressed paperboard containers, including plates, bowls, platters, etc., with any appreciable vertical draw generally have some form of material gathering in the drawn regions, usually depicted as a structure commonly called pleats. The pleats are located around the periphery of a container, in areas in which the vertical drawn portion follows a curved path about the periphery.

During the manufacturing process of forming the container, a process referenced herein as "conversion" of the paperboard blank into a container, the paperboard stock at the outer regions of blank fold to accommodate the excess material gathering at regions where the vertical draw follows such a curved path. As the conversion process continues, mating dies that are used to form the depth or draw of the container move toward each other, and are typically configured as mating dies with little or nominal die clearance between the mating surfaces. In this manner, the mating conversion dies act on each folded segment of paperboard in the outer regions of the container to create formed pleats. As is well known in the art, tightly packed and ironed out pleats, and preferably ones with at least some degree of bonding of pleat layers or integration and re-bonding of the layers of paperboard fibrous material, will provide resistance from separation of the pleat layers when the container is in use.

Thus, one of the ways to improve the appearance and the rigidity of a formed paperboard container it to provide generally inseparable pleats in normal-use conditions, resulting in greater resistance from deformation of the container such as when a load of food items are placed on the container. Further, it is known that poorly formed pleats will result in an unattractive appearance, and regions of delaminated paperboard that act as lines of weakness for possible catastrophic buckling of the paperboard container, sometimes even when the user places a normal load (amount of food) on the container. Thus, prior attempts at increasing plate rigidity have focused on applying increased heat and pressure by the dies to iron out the pleats.

Prior art paperboard plates generally have either randomly-formed pleats, or radially-extending linear pleats that are formed by scoring along a radial line. Such scored pleats are formed in a desired pattern or arrangement by scoring the blank between dies prior to converting the container into its drawn shape. Scoring weakens the material at the points of scoring by damaging the laminar structure of the paperboard, which influences the paper to fold at the scored areas when the paperboard is pressed into a container, such as a plate. Thus, scoring of paperboard prior to converting the plate results in a catastrophic de-lamination of the paperboard in the scored regions, which causes a loss of integrity of the rigid paperboard.

Prior art containers with scored pleats are made with linear pleats formed of linear scores in the blank, and pleats/scores extend radially outward relative the center of the plate. Thus, such pleats common to prior art plates and processes may be described as "linear" along their length, and "radial" as they extend along a radial line across the diameter of the container. Similarly, therefore, such pleats are created by first forming scores in the paperboard blank, wherein such scores are linear along their entire length and extend radially outward along a respective radial line across the diameter of the blank. Such common structure and method of pleated paperboard containers is described in numerous patents, including the following: U.S. Pat. Nos. 4,609,140; 4,606,496; 4,721,499; 5,938,112; and, 7,048,176.

Prior art scored pleats are formed in the shape of the linear radial score. If there is no scoring of the blank for pleats, then randomly-formed pleats result as the paperboard blank is converted into a depth by forming dies. Such randomly formed pleats then naturally form in unspecified arrangements around the outer regions of the container. Randomly-formed pleats often have a linear length and reside along a radially extending line of the container. Randomly formed non-scored pleats may also include non-linear portions of the pleats and portions that do not extend along a radial line. As is known in the art, random non-scored pleats are not desirable, as the uncontrolled pleat formation causes inconsistencies and generally inferior pleats.

Non-scored randomly-formed pleats are not desired due to being less attractive in appearance and non-uniformity of pleats along the outer region of the container. The poor formation of such pleats is due in part to the natural occurrence of an uncontrolled amount of paperboard material gathered into a pleat, simply due to a lack of scoring that would be needed to provide weakened paperboard regions to direct and disperse the "gathering" of paperboard. Similarly, the lack of such score arrangement results in the randomly-formed pleats having undesirable variation in the orientation and/or frequency of such pleats.

Although scoring the blanks for pleat formation, and forming such scored pleats in finished paperboard containers is advantageous and desirable for numerous reasons as described above, such pleats may result in a linear path of weakened paperboard susceptible to creasing or folding when the container is in use and is subject to a load or distortion by being carried by the user. For example, when a container, such as a paper plate, is subject to a heavy load of food and is held by a user in a manner that potentially distorts a region of the plate, the pleat may then act as a line of weakness of the rigidity of the paperboard. The result, of course is that the plate folds along the line of weakness of the pleat, which may be even more likely as the hinge-line of the fold reaches a similar radially extending pleat on the other side of the plate.

Further, linear and/or radial-extending pleats are believed to be susceptible to separation of pleat layers when subject to the compressive and tensile stresses in use, such as when food is loaded on a plate. This is believed to be primarily due to the linear and radial path of the pleat, such that separation of the paperboard propagates along a directly linear path of the radial pleat.

As an example of such features and problems in the prior art, a prior art circular paperboard container (1) is shown in FIGS. 1-2, having a bottom wall 2 with an annular recessing 3 encircling the bottom wall 2, an upturned sidewall 4 extending upward from the bottom wall 2, a relatively flat rim 5 extending outwardly from the sidewall 4, and a downturned lip 6 extending downward from the rim 5 to the edge of the plate 1.

As shown in FIGS. 1 and 2, a plurality of pleats 7 are located around the peripheral region of the container. The pleat typically extends from an area in the sidewall 4, and extends radially outward through the rim 5 and the lip 6 and to the outer edge of the container. The pleats 7 of the container shown in FIGS. 1-2 are linear and each aligned along a respective radially extending axis A-A. This is depicting what is being described as both "linear" and "radially extending" pleats, residing along a cross sectional line of the container diameter.

A alternative specific geometry of the plate structure is common. For example, prior art container geometry may not include a recess ring 3 around the bottom wall 2, and may have a curved or rounded rim 5, rather than a flat or substantially horizontal portions of the rim 5. Still other paperboard designs are elliptical, obround, or rectangular in shape rather than substantially round. In such non-circular containers, pleats generally form where the container has curvature in the well or drawn region. Thus, much like the linear and radially extending pleats shown in FIGS. 1-2, non-round containers typically include pleats that are linear, and reside along a radially extending line relative the radial line of the curved segment of the container.

Also, the method of manufacturing plates after forming a scored blank are well accepted and common. Paperboard containers are formed from a blank cut from paperboard sheet stock. Typically, the score lines are formed as the blank is cut from the sheet. Thus it is known that the containers must be formed by pressure exerted between mating manufacturing ("conversion") dies, while preferably optimizing the moisture content of the paperboard and subjecting the paperboard to heat and pressure from the dies to facilitate pleat forming. A prior art circular blank 8 is shown in FIG. 3, such as would be suitable for forming the paperboard plate container of FIGS. 1 and 2, when drawn into the shape shown in the cross-section view of FIG. 4. A plurality of non-segmented radial, linear score lines 9 are located around the edges of the blank 8, which are designed to form the radial, linear pleats 7 in the plate of FIGS. 1-2. thus, the scores 9 formed in the manner of the prior art are formed as thin bands of disrupted or delaminated paperboard that have score lengths that are linear and which extend radially outward relative a cross sectional line B-B of the diameter of the paperboard blank.

Other shapes and sizes of blanks are used to create other types of prior art containers, and these prior art blanks may be scored as desired. In sharply curved areas of the blank and smaller round plates or similar containers, where pleats form close to one another, scoring is usually closely spaced. Regardless of the number or arrangement of score lines in such prior art containers, however, linear radial scores result in radial linear pleats in the container 1. Such pleats are subject to susceptibility to separate along the linear pleat path. Further, the general alignment of opposed straight pleats at opposite edges of the plate is susceptible of forming a crease line across the width of the container, resulting in buckle failure of the structure. Thus, there is a need for an improved paperboard container structure, and method for manufacturing the same, which has increased rigidity and optimized gathering of pleated material.

The present invention is provided to solve the problems discussed above and other problems, and to provide advantages and aspects not provided by prior containers of this type. A full discussion of the features and advantages of the present invention is deferred to the following detailed description, which proceeds with reference to the accompanying drawings.

SUMMARY OF THE INVENTION

The present invention provides a paperboard container including a bottom wall, a sidewall extending upward from the bottom wall, a rim extending outward from the sidewall, and with pleats extending outwardly through at least a portion of the sidewall rim and/or lip. According to one aspect of the invention, a plurality of pleats are non-linear in shape. According to another aspect of the invention, the pleats extend outward non-radially relative a radial line along the diameter of the container.

The present invention also provides a method of manufacturing a paperboard container using a paperboard blank and a set of forming dies. The method includes creating scores around an outer region of the blank, so that at least some of the score lines are non-linear in shape and/or do not extend radially along a radial line through the origin of the radius of curvature of the container. The method further includes the step of pressing the blank between the forming dies to form the paperboard container with pleats along the scores.

The present invention also provides a method of manufacture of paperboard containers such that gathering of material into pleats is optimized at the different areas of the container profile and depth of draw.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which:

FIG. 13 is an elevated perspective view of a quartered section of a container according to another embodiment of the invention, having diverging scores;

FIG. 14 is a top plan view of a segment of the outer peripheral area of a paperboard blank for use in manufacturing the container shown in FIG. 13;

FIG. 15 is a top plan view of that which is shown in FIG. 13;

FIG. 23 is an elevated perspective view of a quartered section of a container according to another embodiment of the invention, having linear scores in the paperboard with an extent of the score extending in a non-radial direction relative a cross sectional line through diameter of the blank;

FIG. 24 is an elevated perspective view of that which is shown in FIG. 23, shown from an opposite side;

FIG. 25 is a top plan view of a segment of the outer peripheral area of a paperboard blank for use in manufacturing the container shown in FIG. 23;

FIG. 26 is a top plan view of that which is shown in FIG. 23;

DETAILED DESCRIPTION

Figure 1:
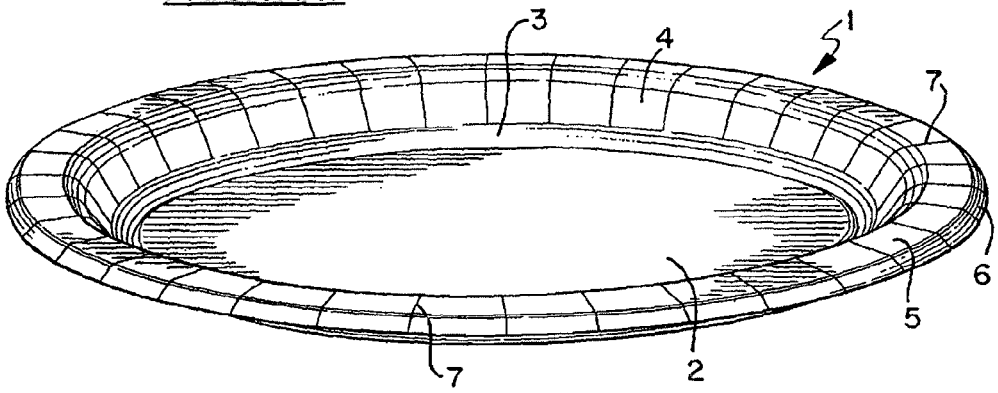
FIG. 1 PRIOR ART
FIG. 1 is an elevated view of a prior art paperboard container.

While this invention is susceptible of embodiments in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention provides a novel scoring arrangement and a novel pleat arrangement for pressed paperboard containers, as well as a novel method of manufacturing paperboard containers using such score arrangements. The invention is discussed herein primarily relating to use in pressed paperboard plates that have a substantially round outer dimension and a constant outer radius of curvature of the bottom. However, other paperboard container types and shapes can benefit from the present invention, including a bowl, platter, tray or similar paperboard container. Accordingly, the preferred plate designs discussed herein are used by way of example only, and the present invention is not limited to these designs, nor is it limited to relatively shallow paperboard containers such as a plate.

Figure 5:
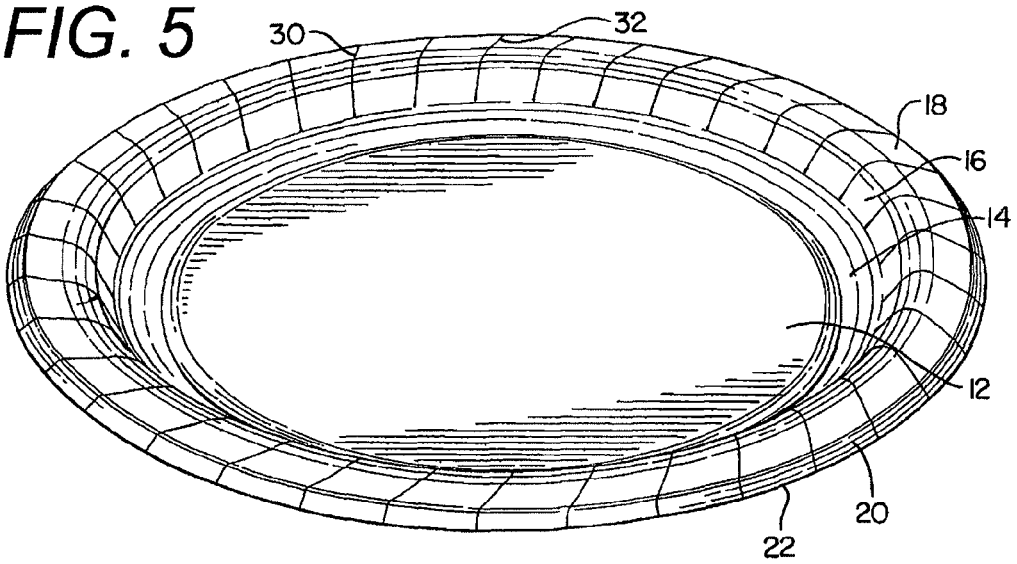
FIG. 5 is an elevated perspective view of a container according to an embodiment of the present invention shown in FIG. 4.
Figure 6:
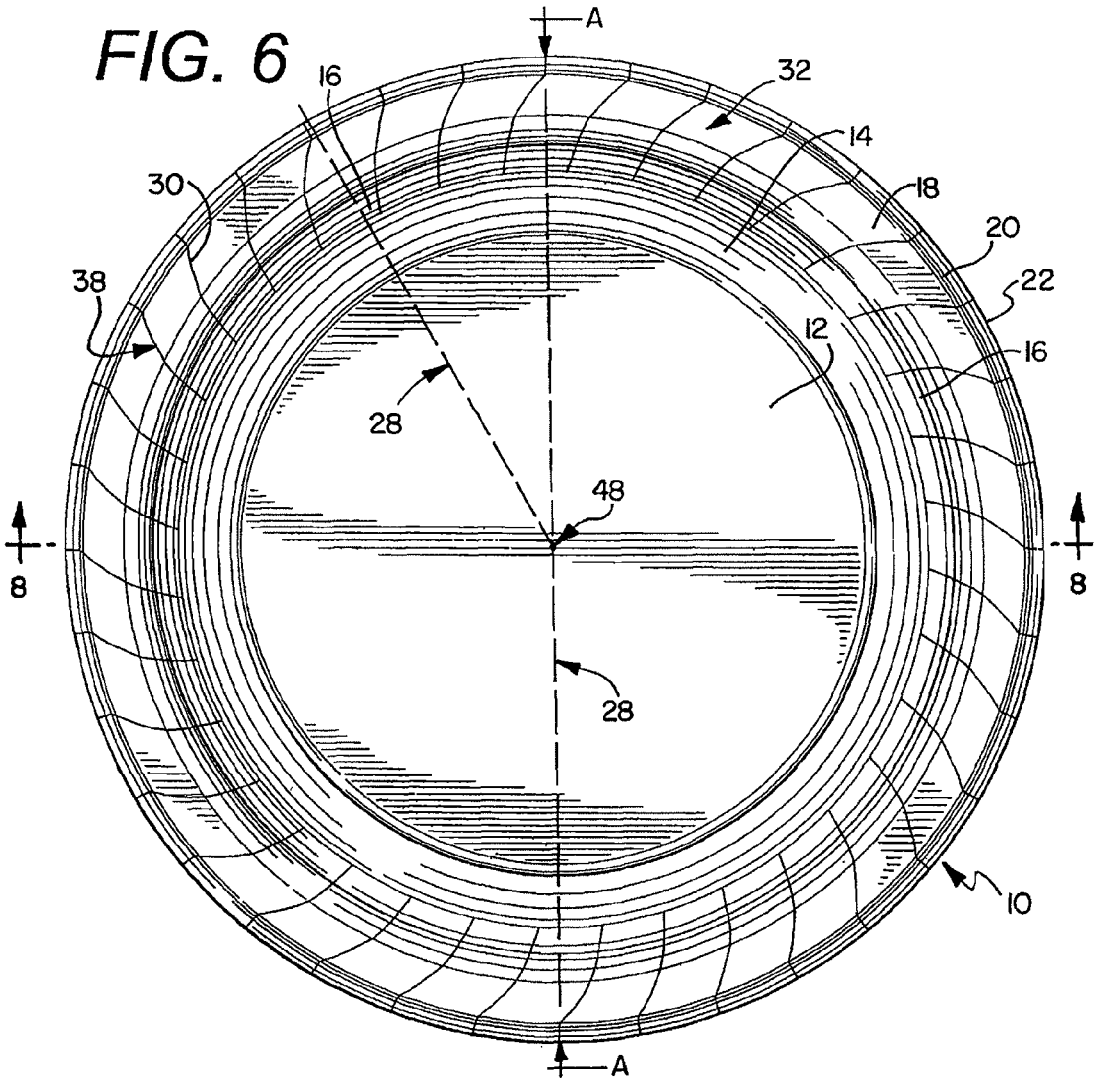
FIG. 6 is a top plan view of the container as shown in FIG. 5.
Figure 8:
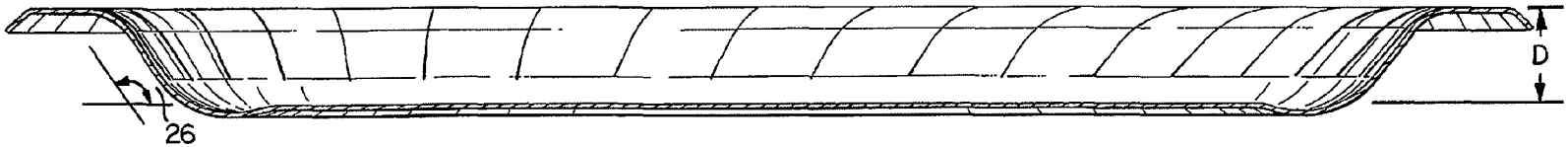
FIG. 8 is a cross-sectional view of the container shown in FIG. 6, taken along section axis 8-8.
Figure 10:
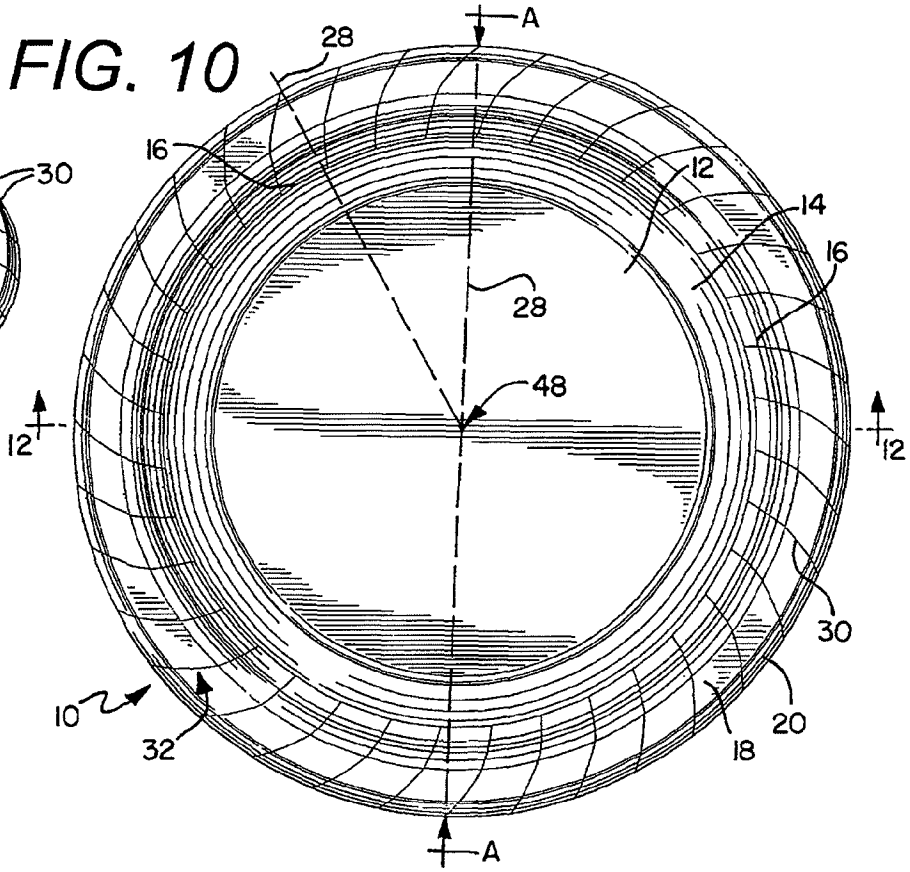
FIG. 10 is a top plan view of the container shown in FIG. 9.
Figure 9:
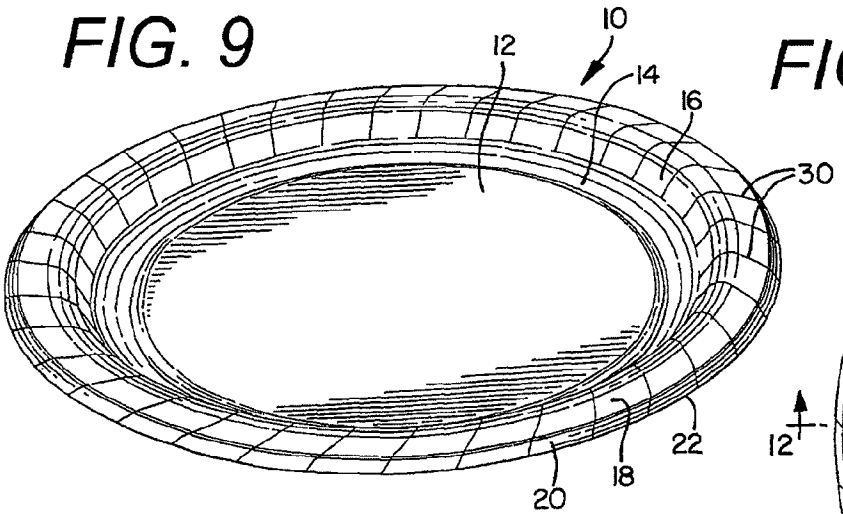
FIG. 9 is an elevated perspective view of a first alternative embodiment of a container according to the present invention.
Figure 11:
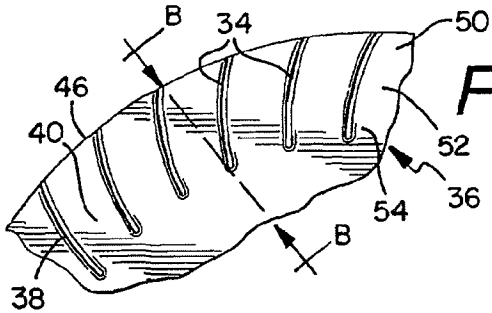
FIG. 11 shows a partial segment of an outer peripheral area of the paperboard blank used in the manufacture of the container shown in FIG. 9, similar to the segment view of FIG. 7A, yet with the entire length of the scores being arcuate.
Figure 12:
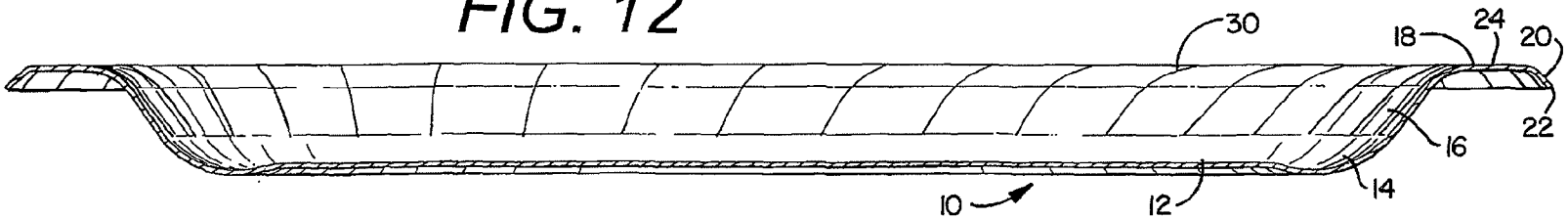
FIG. 12 is a cross-sectional view of the container shown in FIG. 9.
Figure 16:
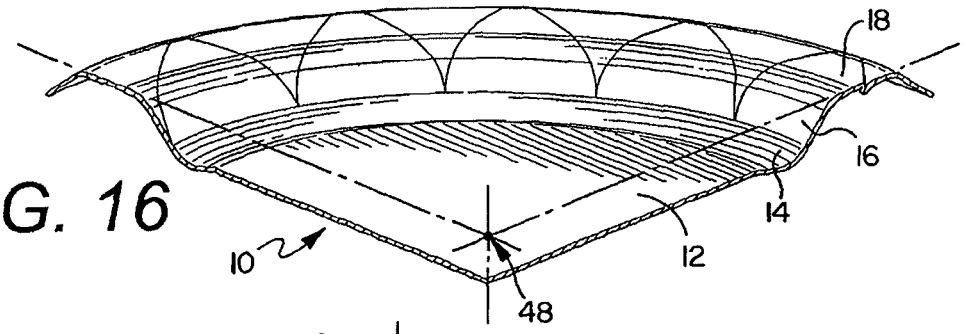
FIG. 16 is an elevated perspective view of a quartered section of a container according to another embodiment of the invention, having diverging scores and with a linear score in the outermost region of the container.
Figure 17:
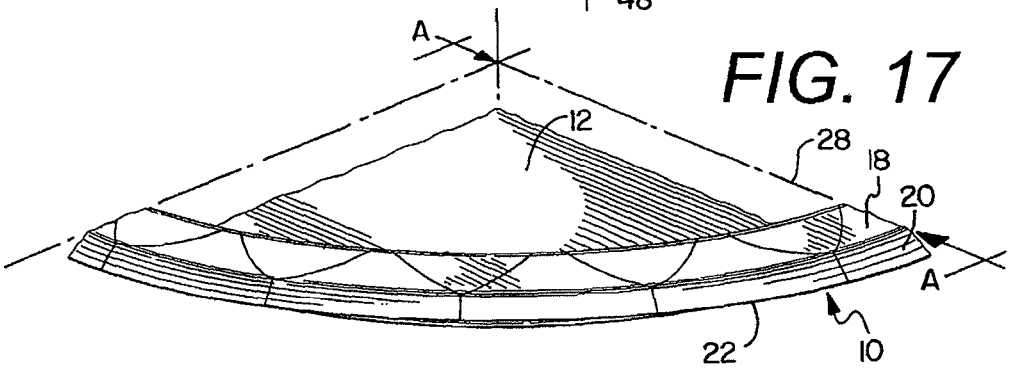
FIG. 17 is an elevated perspective view of that which is shown in FIG. 16, shown from an opposite side.
Figure 18:
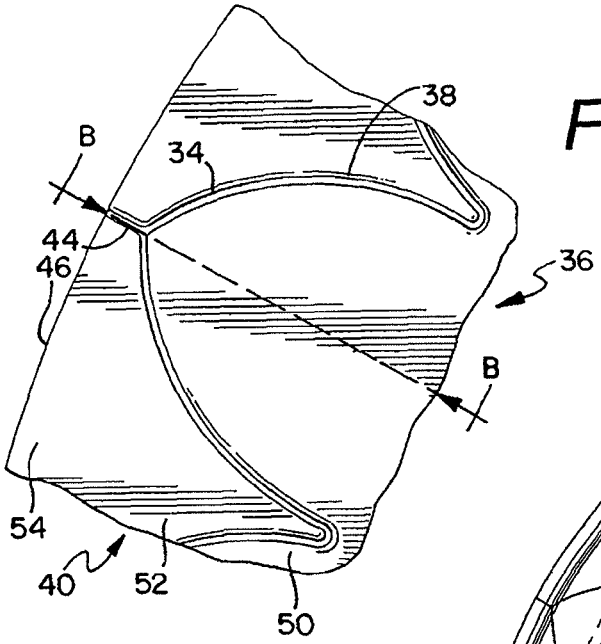
FIG. 18 is a top plan view of a segment of the outer peripheral area of a paperboard blank for use in manufacturing the container shown in FIG. 16.
Figure 19:
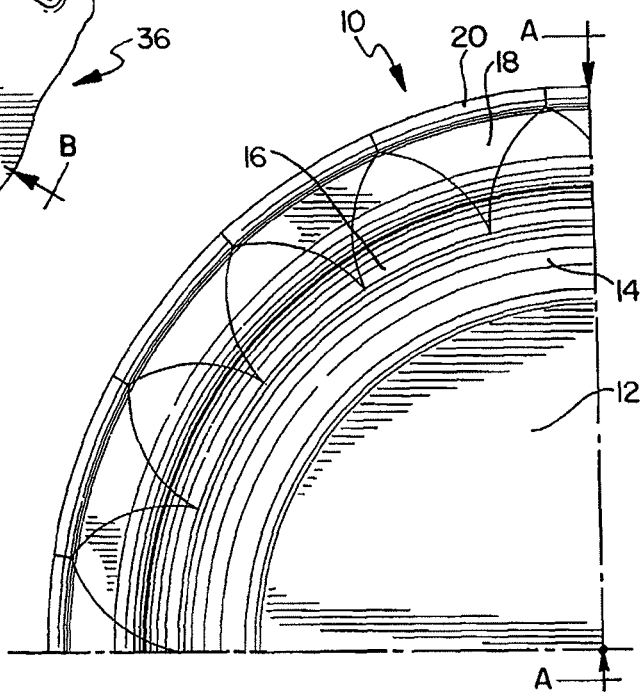
FIG. 19 is a top plan view of that which is shown in FIG. 16.

A paperboard container 10 incorporating the preferred embodiment of the present invention is shown in FIGS. 5-6 and 8. The paperboard container 10, shown as a round paper plate, includes a bottom wall 12 having an annular well or recess ring 14 encircling the bottom wall 12, an upturned sidewall 16 extending upward from the bottom wall 12, a rim 18 extending outwardly from the sidewall 16, and a downwardly-directed lip 20 extending from the rim 18 to the edge 22 of the container 10. The specific geometry of the plate shape may differ from the shape shown in the Figures, while still practicing the present invention. For example, in keeping with practice of the present invention described herein, a suitable plate shape may include structure with a curved rim 18 region that does not have a flat or horizontally extending region, as shown in FIGS. 5 and 6. Also, the plate 10 need not have a recess ring 14, and instead may directly transition from a bottom wall 12 to a sidewall 16.

The container shown in FIGS. 5 and 6 is one possible geometric shape of a finished paperboard plate, with a moderately deep draw of paperboard positioning the bottom wall 12 a given distance of plate bottom depth D relative to the upper chime 24 of the plate. Thus, the length of the sidewall 16, and the sidewall angle 26 relative to the bottom wall 12, contributes to the depth D of the container 10. Such geometric variables, sidewall angle 26 and depth D, may effect desired rigidity of the container, such that a smaller sidewall angle 26 (closer to perpendicular the bottom wall 12) and greater depth D, may provide enhanced container rigidity. Thus, a manufacturer of paperboard containers, such as plates, may desire to use other geometric features that will have the effect of increasing the amount of paperboard to be gathered into pleats. The invention disclosed herein is useful to control and optimize such pleat formation when such geometric features alter the amount and location of paperboard gathering necessary when the finished container is made.

As shown in FIGS. 5 and 6, a number of pleats 30 are located around the peripheral area 32 of the plate 10, beginning in the sidewall 16 and extending outwardly through the rim 18 and the lip 20 to the edge 22 of the plate 10. The pleats 30 of the present invention are preferably formed in a uniform or patterned arrangement, formed along scores 34 in the paperboard of the manufacturing blank 36. However, in other containers, such as non-round trays, pleats are only formed in the areas of the sidewall that follow a curvilinear path about the bottom 12. That curvilinear path has a radius of curvature with a radius origin defining a common point of radial line of the curve. As such, pleats according to this invention may be provided by having an extent that does not reside on such a radial line.

The pleats 30 of the present invention significantly differ from the pleats 7 of prior art containers 1. The pleats 30 of the container shown in FIGS. 5 and 6 extend outwardly in a non-linear and non-radial orientation. As shown in FIG. 6, the pleats 30 therefore do not extend entirely along a "radial" line 28 of a cross-sectional axis A-A of the diameter of the container 10. The radial line 28 is essentially a line extending from the focus 48 of the radius of the container 10, such that the focus 48 of the radius serves as the origin 48 of the radial line 28. The pleats 30 of the present invention have a curvilinear length 38 passing through at least part of the sidewall 16 and rim 18 of the plate 10. In the preferred form of the invention, the pleat 30 is segmented in a away that it changes direction in the outer area of the plate, and preferably extends through the lip 20 along a radially-extending line (relative to a radial line of the container).

Figure 7:
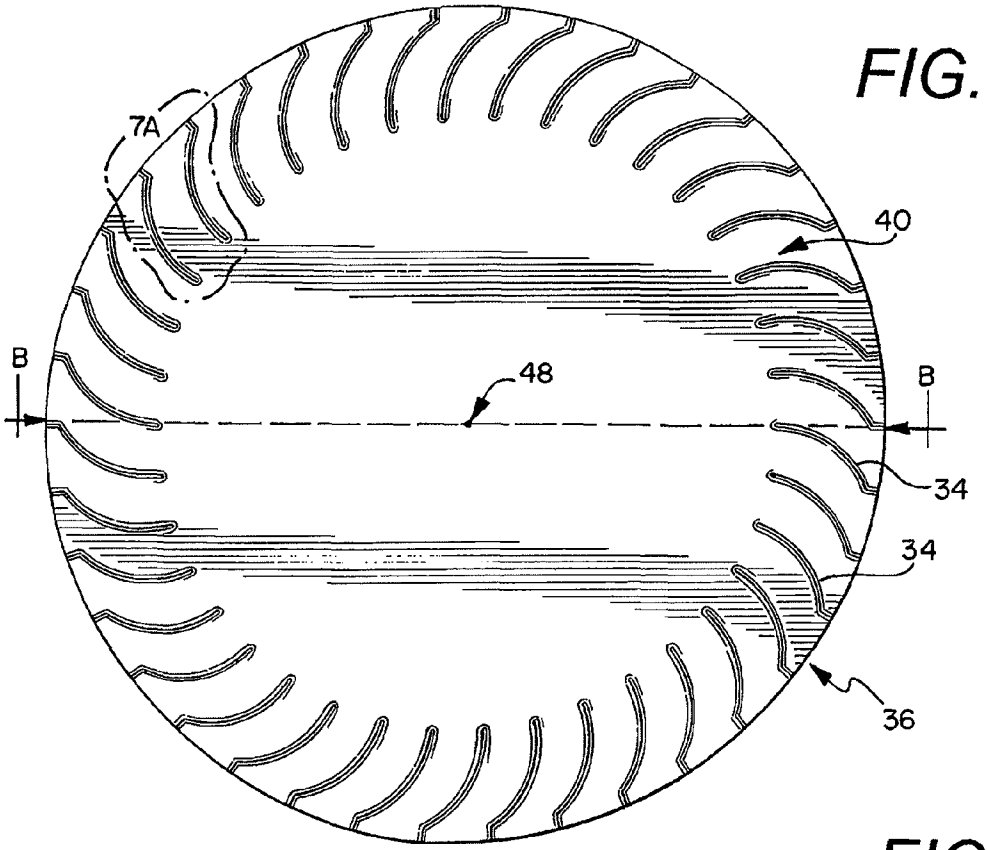
FIG. 7 is an top plan view of a circular blank having a scoring arrangement according to the present invention, such as may be used for manufacture of a container, as shown in FIG. 5.

A blank 36 used in forming the plate 10 of FIGS. 5-6 is illustrated in FIG. 7. This representation of the preferred blank 36 depicts a plurality of spaced non-linear, non-radial, segmented score lines 34 around the outer peripheral area 40 of the blank 36. Thus, the scores 34 each have an extent 42 that is substantially non-linear and non-radial, changing to a linear segment 44 near the outer edge 46 of the blank 36. This score 34 shape and arrangement provides the requisite structure for forming pleats 30 having an overall non-linear and non-radially-extending configuration along the outer region 32 of the plate 10, utilizing manufacturing steps that are otherwise common.

The present invention is useful for providing a paperboard container with increased rigidity, which is an exhibited advantage when in use. Paper board containers are often used for food preparation, food packing, and food service. For example, paper plates formed into a drawn shape for food service. In use, containers such as paper plates are subject to the force of gravity of food placed on the plate. Typical normal-use load of food differ by the size (diameter) of the plate, and usually vary between a few ounces for small plates to eleven ounces for larger plates. A typical paper plate may be loaded with more than 11 ounces of food items by a user; and then held by one hand as it is carried by the user. The gravity force of the normal use load of material on the plate causes stress on areas of the plate, exhibited as resulting stresses that potentially deform the paperboard. When a load is applied on a plate that is typical of normal use of the plate, it is advantageous for the plate to remain rigid, with minimal deflection and for it to not buckle across the plate width. The rigidity or stiffness of a paper plate is the result of numerous factors, including geometry of the plate, thickness of the paper stock, and inseparability of the pleats. The present invention provides plate rigidity increase by a structure that results in greater resistance to pleat separation, and a non-radial structural component in the outer area 32.

Certain tests have been devised in the industry to assess the rigidity of a paperboard containers, with particular focus on rigidity of paper plates. One such test is the Single Serving Institute test (SSI test). The SSI test measures the force (by grams of weight) required to deflect on side of the plate (at the rim portion that is opposite the area of the user's thumb on top of the rim) to a measure of ½ inch (i.e., grams per 0.5 inch deflection).

Another measure of plate rigidity may be observed by applying a force on the plate rim and determining whether the plate buckles, or steadily increasing deflection to observe the amount needed to buckle the plate. Buckling usually involved forming of a crease in the bottom wall and opposed portions of the sidewall, and separation of some pleats. Such buckling of the plate is a different measure of rigidity than SSI testing in that it is a measure of structural rigidity as resistance to catastrophic failure of the plate, such as if the plate folds back on itself when in use and the food on the plate will shift upon or fall from the plate bottom.

Another indication of rigidity is the perceived plate stiffness by a user when handling the plate. A user that is handling a plate may flex the plate to some degree to distort the plate from its flat state. A user may also assess rigidity of the plate by lightly bending the plate in each direction, downward as potentially loaded with food, or upwardly in a folding action.

Practice of the present invention provides enhanced rigidity or stiffness to such paperboard containers. This is achieved by at least three principle structural mechanisms: enhanced resistance from pleat separation; enhancing stiffness in the outer region of the plate with an arrangement of rigid pleat structures; and, enhancing resistance from buckling along a lineal path through the outer region of the plate.

For suitable rigidity of a container, such as a paperboard plate, resistance of pleat separation (resistance from separation of the folded paperboard layers) is preferred. Because the linear score lines 9 of prior art plates result in pleats 7 that are generally aligned at opposite sides of the plate, such an arrangement of pleats gives rise to possible buckling of the plate across a hinge-line of the aligned pleat. The "non-radial" and/or non-linear pleats 30 of this invention offer advantages in rigidity and strength as compared to prior art linear, radial pleats 7, which are more susceptible to pleat separation and propagation. Pleat separation, or pleat failure, occurs primarily due to tensile and/or compressive stresses acting on the paperboard of the pleat, as well as shear stresses. When subject to the tensile and compressive stresses, prior art linear, radially-extending pleats are susceptible to separation of the pleat paperboard layers. In contrast, non-linear and/or non-radial pleats of the present invention are more resistant to separation and failure, partly because the stresses on the paperboard are exhibited directly normal against only a small portion of the pleat. Thus, the tensile and compressive stress components tending to cause pleat separation are lower in non-linear and/or non-radial pleats than typical pleat arrangements. Further, because of such unique arrangement, non-linear pleats are more resistant to propagation of pleat separations caused by shear stresses.

Another structural feature of the invention is a pleat arrangement that utilizes the enhanced stiffness of a pleat, relative adjacent paperboard, to provide a stiffening component on the outer regions of the container. Non-linear and/or non-radial pleats of this invention provide circumferentially-spaced directional component that common linear, radial pleats 7 do not possess. Pleats formed according to the invention exhibit this benefit because, in use, a portion of a bending force in the rim 18 or lip 20 of the plate 10 acts transversely to the pleat 24, bending across the double or triple paperboard thickness of the pleat, rather than acting directly on the pleat to separate the pleat. This aspect further enhances rigidity of the paperboard container. Also, this aspect of the invention provides a container 10 that feels rigid to a user when flexing the plate 10 or twisting the plate 10 from its planar state. The present invention also provides a method of forming paperboard containers, such as paper plates or the like, having increased strength and rigidity as compared to prior art containers. Generally, the method includes forming paperboard containers 10 having non-linear and/or non-radial pleats 24 around the periphery of the container. Preferably, paperboard for plate manufacture is moistened to a level in the range of about 6% to 10%, as is typical in the industry. The paperboard may be treated with a liquid-resistant coating to prevent penetration of liquids from food sitting on the plate 10, which is also a typical feature.

Figure 3:
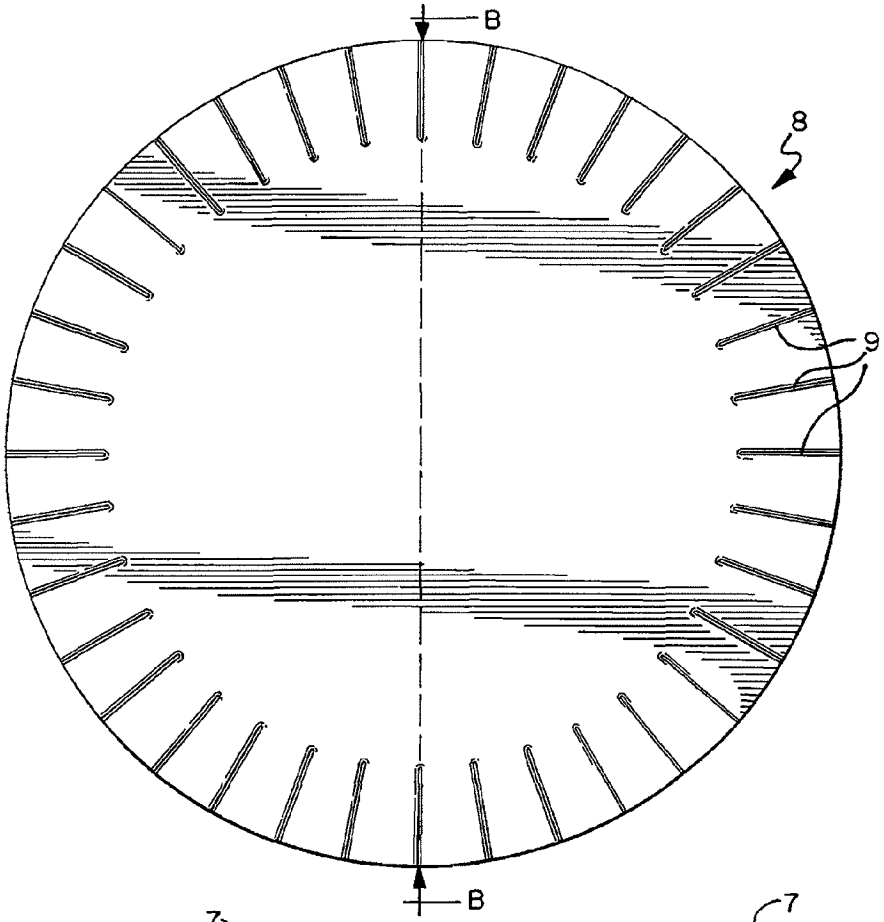
FIG. 3 PRIOR ART
FIG. 3 is a top plan view of a prior art circular blank used in manufacturing a container, such as is shown in FIG. 1.
Figure 4:
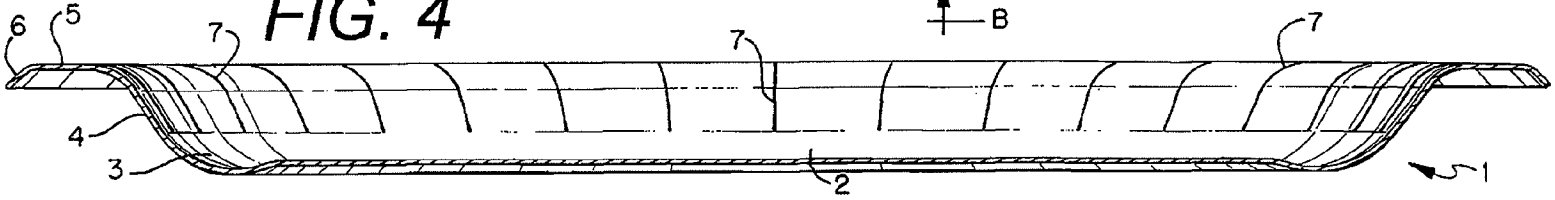
FIG. 4 is a cross-sectional view of the container shown in FIG. 1, taken along section line 4-4.

The paperboard stock is formed into blanks of a shape and size appropriate for the desired finished container. An arrangement of score lines 34 are formed into the blank 36 with an arrangement of scoring knives (not shown), arranged to create scores 34 in the specific desired shape (the path of the length of the score) and configuration. Scoring of the paperboard provides the benefit of directing the orientation of the pleat such that the material folds with one crease on the upper (coated consumer) side of the container, and essentially two creases are formed with the bulk of the pleat residing on the opposite (uncoated backside) of the container. The scores 34 are formed by pressing the paperboard between the two dies (not shown), whereby a protruding score knife acts against the upper side of the paperboard, which is pressed into a cavity of the mating die located on the opposite side (underside) of the blank 36. In this manner, the scoring operation, causes de-lamination along the length of the score, such as is commonly practiced with prior art linear, radially-aligned scores 7 (FIG. 3). The weakened scoreline results in facilitating the pleats to form by paperboard material folding in a particular manner when forming the finished container.

Figure 7A:
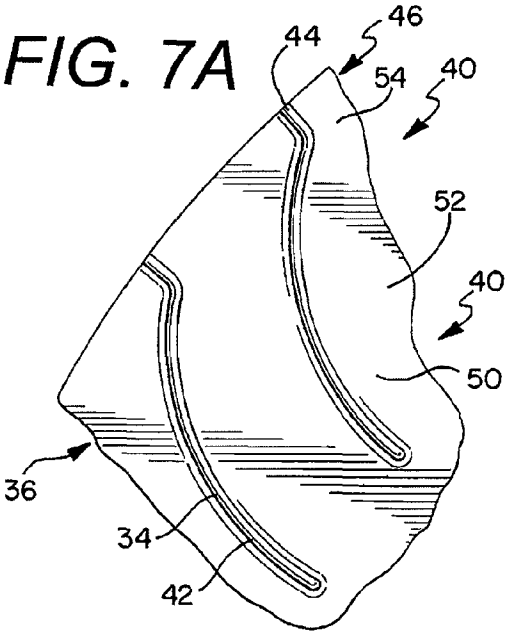
FIG. 7A is a partial section view taken from 7A of FIG. 7 showing a segment of the outer periphery.

In the first embodiment shown in the Figures, the container 10 of FIGS. 5 and 6 are formed into converted plates 10 with non-linear and non-radial pleats 30 (i.e., having a profile or shape of the pleat length that extends non-radially and non-linear), as a result of the arrangement of scores 34 of the blank 36 (FIGS. 7 and 7A). The blank 36 has a number of evenly-spaced scores 34 arranged about the outer peripheral area 40 whereby an extent of the length of each such score 34 does not reside along the radial line B-B, thus providing the structure of a score 34 that is characterized as non-radially extending along its length. Further, as a portion of the length of this score 34 is curvilinear in shape, and here is arcuate, each such score 34 of FIG. 7 is characterized as non-linear along the score 34 length.

Figure 2:
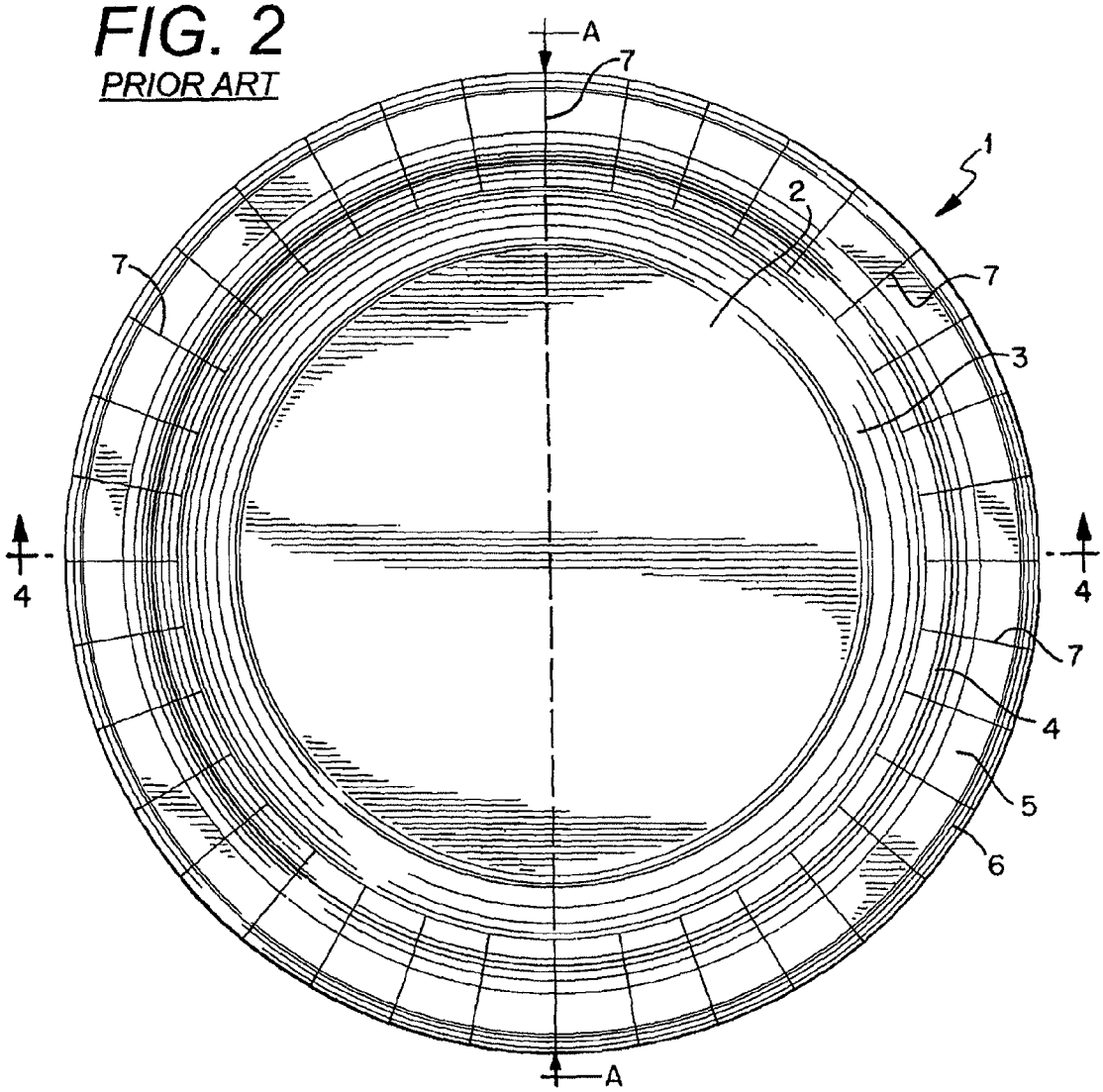
FIG. 2 PRIOR ART
FIG. 2 is a top plan view of the container shown in FIG. 1.

By way of an example, a preferred embodiment of the present invention (plates shown in FIG. 5, formed with the blank of FIG. 7) has shown significant improvement over paperboard container rigidity of containers having linear, radial pleats. Paper plate samples formed at various moisture levels were tested for rigidity using an SSI testing apparatus, measuring grams of force per ½ inch deflection. Ten plate samples using a prior art pleat design shown in FIG. 1 and ten plate samples using a new pleat design (shown in FIG. 5) were tested, with variable values of moisture level, often a significant factor for forming well-ironed and -formed pleats. The plates with curved pleats 24 (FIG. 5) had, on average, 10.8% greater rigidity than the prior art plates having common linear, radially-extending pleats 7 (FIG. 2). Specifically, the results showed that, at 9% moisture content of the paperboard, the plates with curved pleats 30 had an average of 11.7% greater rigidity. At 10% moisture, the plates with curved pleats had an average of 10.5% greater rigidity. Two sets of sample plates at 11% moisture were tested. In the first test set at 11% moisture, the plates with curved pleats had an average of 8.7% greater rigidity. In the second test set at 11% moisture, the plates with curved pleats had an average of 15.3% greater rigidity. At 12% moisture, the plates with curved pleats had an average of 12.7% greater rigidity. At 13% moisture, the plates with curved pleats had an average of 5.9% greater rigidity.

While the preferred embodiment described in theses tests have curved non-linear and non-radial pleats 30 formed from scores 34 with the configuration shown in FIGS. 7 and 7A, other pleat configurations that include at least some extent of non-linear shape, and/or a portion that does not extend radially outward, may also be used. Additionally, non-radial pleats may be formed segmented lineal portions to achieve the objective of the present invention. One possibility of such segmented pleats combines two or more lineal or non-lineal-shaped lengths of scores 34 of the blank 36 that are joined end-to-end, or in close terminal proximity, to form a suitable non-linear and/or non-radial pleat in the finished (converted) container 10. For example, a non-linear segmented pleat may combine two or more linear segments (such as a V-shaped or Z-shaped pleat), two or more non-linear segments, or a combination of linear and non-linear segments. Likewise, the score lines 34 on the blanks 36 of the present invention are made in accordance with such pleat 30 configurations. Thus, the present invention also contemplates the use of a manufacturing step in which a score 34 configuration of a blank 36 of paperboard are non-linear in shape and/or that do not extend radially outward. These variations represent alternative embodiments that are shown in the Figures, and described below.

Alternative embodiments of the invention are shown in FIGS. 9-45. The embodiments, although very similar in structure and method of manufacture to that of FIGS. 5-8, differ in the score configuration and/or shape (or "profile") of the score length. As with the first embodiment described, the pleats 30 of each alternate embodiment container 10 have an extent of pleat length that resides in a path other than a respective radial line A-A, defined by a cross-sectional axis of the diameter of the plate 10. In other words, at least an extent of the pleat length that extends transverse a radial line (i.e., an axial line passing from the focus of the sidewall radius of curvature radially outward). Also, at least a portion of the pleat length of such embodiments may extend in a non-linear path, possibly with the entire pleat length being non-linear due to segmented lineal or curvilinear lengths of pleat.

Further, similar to the embodiment shown in FIGS. 5-8, each alternate embodiment utilizes a method of manufacture according to common forming methodology and with non-linear and/or non-radial scores formed in the paperboard blank. In each of the alternate embodiments shown in FIGS. 9-45, the structural elements of the blank 36 and the container 10 are identified similar to the first embodiment described above, incorporating the disclosure provided above into the description of the alternate embodiments. Thus, each embodiment shown in the Figures have non-linear and non-radially-extending pleats 30 of the container 10. Further, such containers 10 are formed by practicing the method of the present invention, wherein a paperboard blank 36 is scored by conventional method of scoring dies with the invention feature of forming score 34 lengths which are non-linear and/or non-radial relative a radial line B-B of the blank 36. Thus, utilizing conventional forming dies in converting the blank 36 into the container 10, with mating dies that are heated to apply appropriate heat and pressure on the blank 36 to form the cavity of the container 10, the benefits of the invention are realized by forming pleats 30 with the aforementioned features.

In FIGS. 9-12, the blank 36 (FIG. 11) is formed by a method of scoring curved scores 34 along the entire length of the score 34. Thus, the container 10 is formed with curvilinear pleats 30, as shown and described above. As with each embodiment herein, the degree of curvature and number and spacing of such scores 34 and resulting pleats 30 may be altered as appropriate for the geometry and size of the container 10 while maintaining the objective of having at least a plurality of pleats 30 with a non-linear and non-radial pleat length.

FIGS. 13-15 and FIGS. 27-30 similarly show alternate score 34 and pleat configurations in which the entire length of the score 34 and plurality of pleats 30 are curved or arcuate. FIGS. 16-19 show similar score 34 and pleat 30 configurations, with a terminal portion in the outer region 54 of the blank 36, and lip 20 of the container 10, having a lineal segment of respective score 34 and pleat 30. This is similar to the embodiment shown in FIGS. 5-8, wherein the pleat 30 in the lip 20 may reside along a radially-extending line 28, yet other regions of the pleat 30 are transverse the radial line 28.

Figure 20:
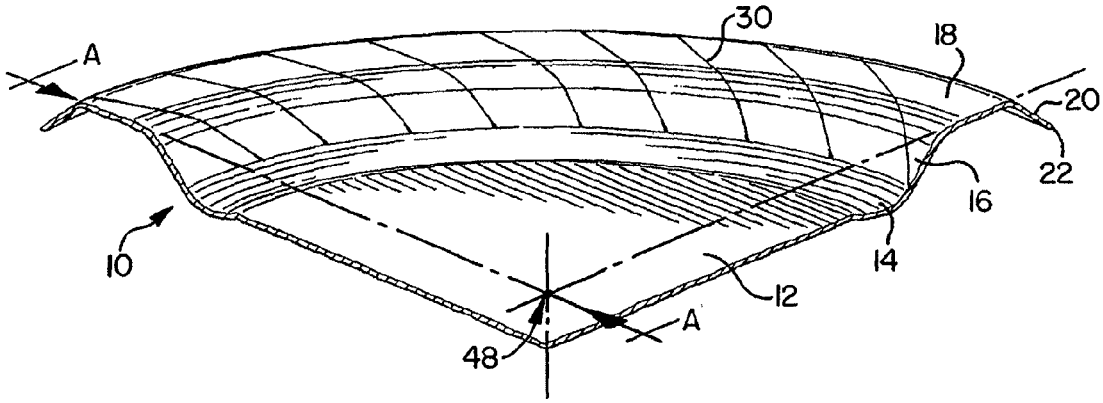
FIG. 20 is an elevated perspective view of a quartered section of a container according to yet another embodiment of the invention, having linear scores in the paperboard extend in a non-radial direction relative a cross sectional line through diameter of the blank.
Figure 21:
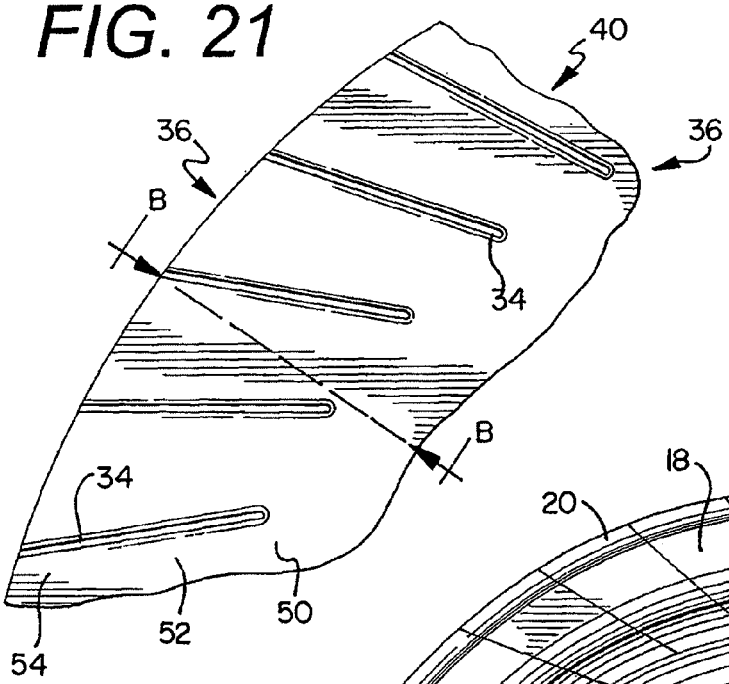
FIG. 21 is a top plan view of a segment of the outer peripheral area of a paperboard blank for use in manufacturing the container shown in FIG. 20.
Figure 22:
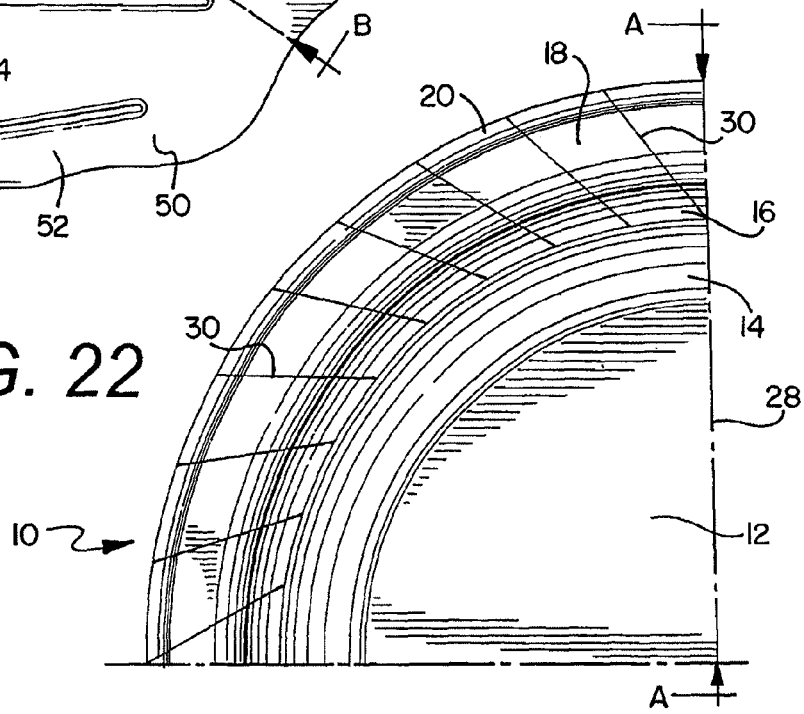
FIG. 22 is a top plan view of that which is shown in FIG. 20.
Figure 27:
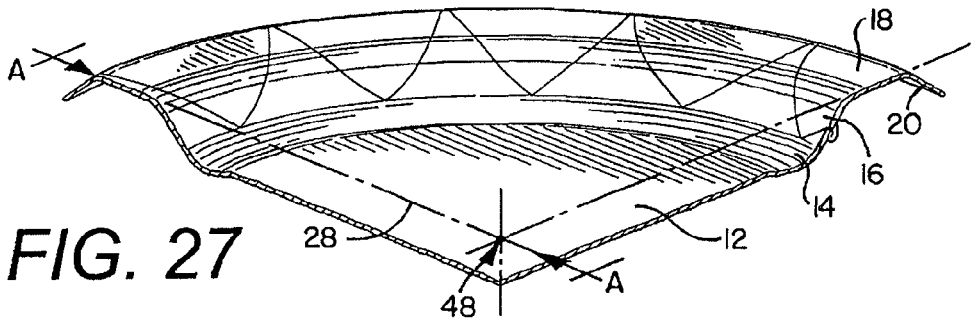
FIG. 27 is an elevated perspective view of a quartered section of a container according to an alternative embodiment of the invention, having converging scores.
Figure 28:
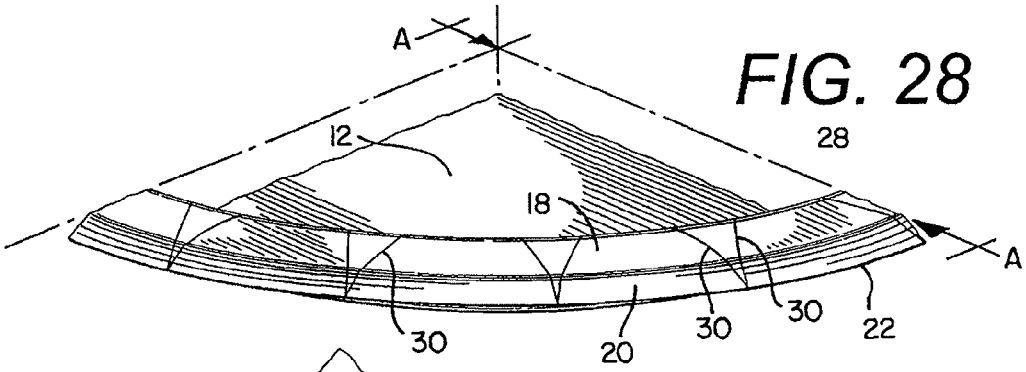
FIG. 28 is an elevated perspective view of that which is shown in FIG. 27, shown from an opposite side.
Figure 29:
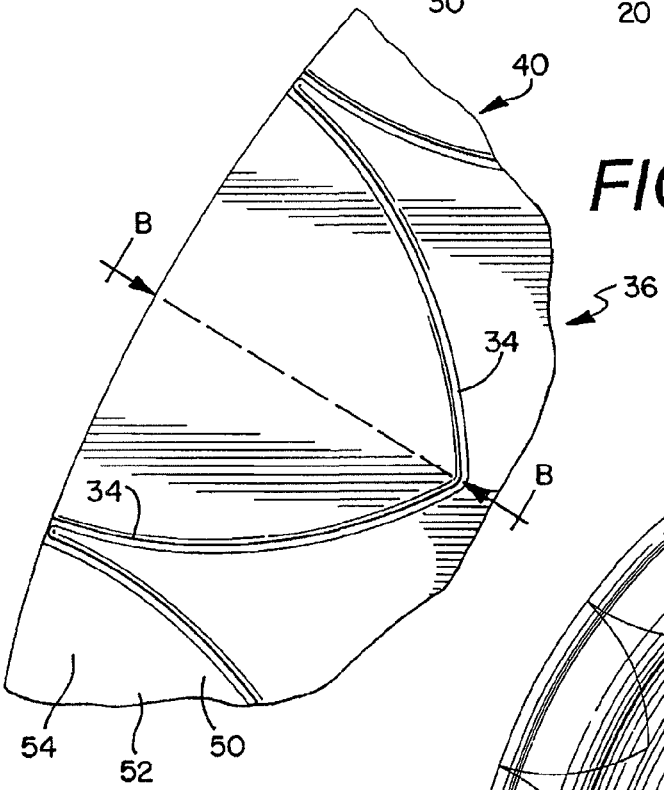
FIG. 29 is a top plan view of a segment of the outer peripheral area of a paperboard blank for use in manufacturing the container shown in FIG. 27.
Figure 30:
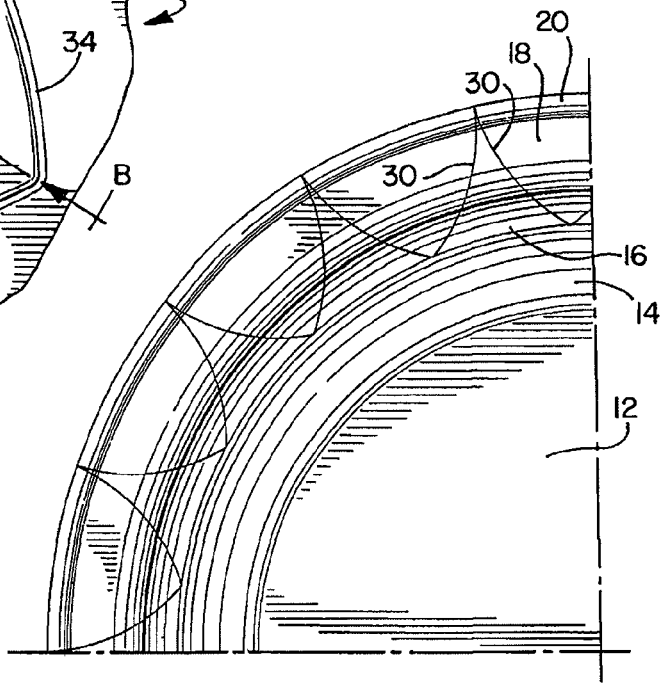
FIG. 30 is a top plan view of that which is shown in FIG. 27.
Figure 31:
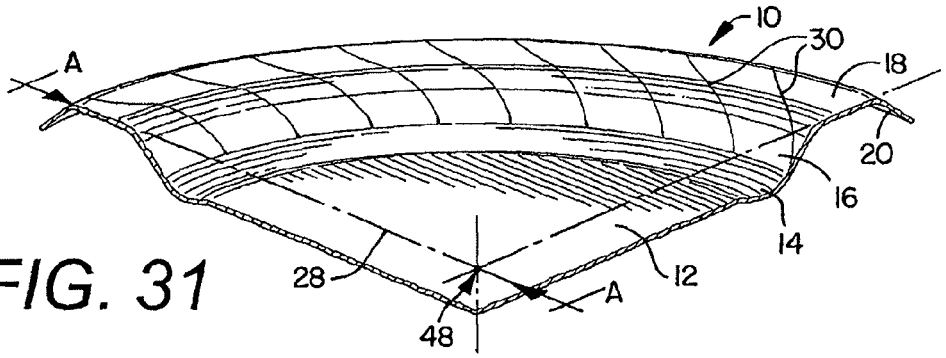
FIG. 31 is an elevated perspective view of a quartered section of a container according to an alternative embodiment of the invention, having scores formed along a curvilinear path that is generally S-shaped.
Figure 32:
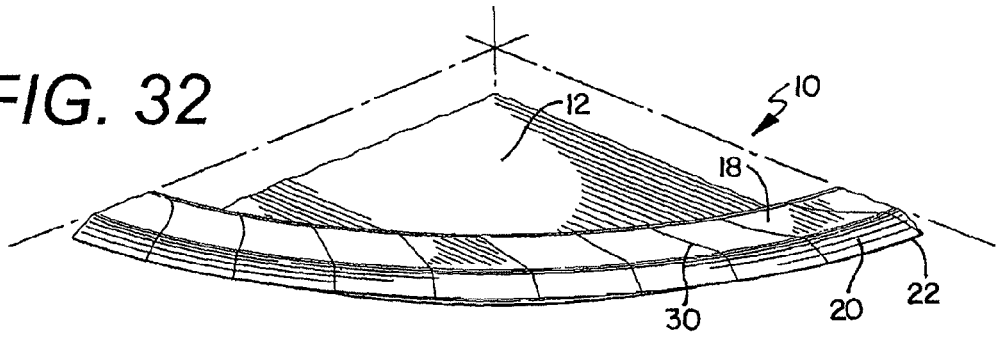
FIG. 32 is an elevated perspective view of that which is shown in FIG. 31, shown from an opposite side.
Figure 33:
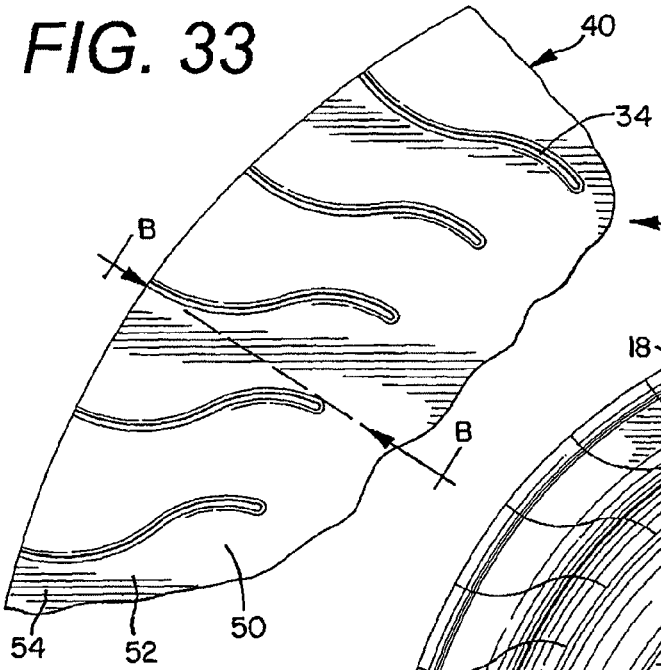
FIG. 33 is a top plan view of a segment of the outer peripheral area of a paperboard blank for use in manufacturing the container shown in FIG. 31.
Figure 34:
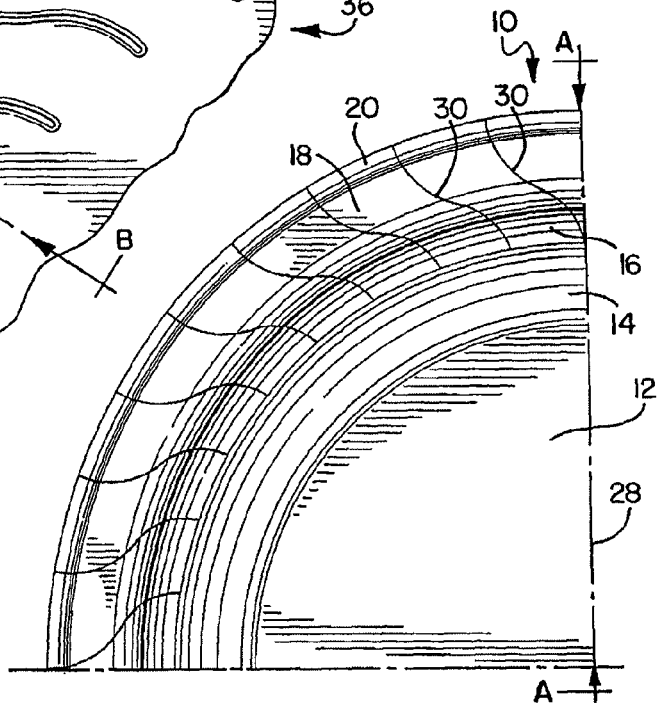
FIG. 34 is a top plan view of that which is shown in FIG. 31.
Figure 35:
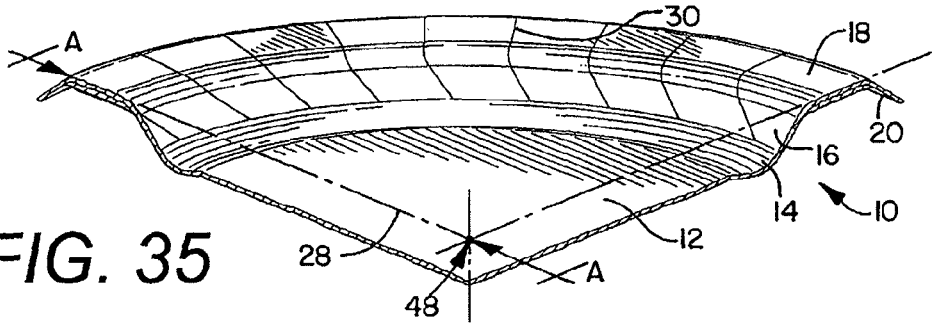
FIG. 35 is an elevated perspective view of a quartered section of a container according to an alternative embodiment of the invention, having scores formed along a segmented lineal path that is generally S-shaped.
Figure 36:
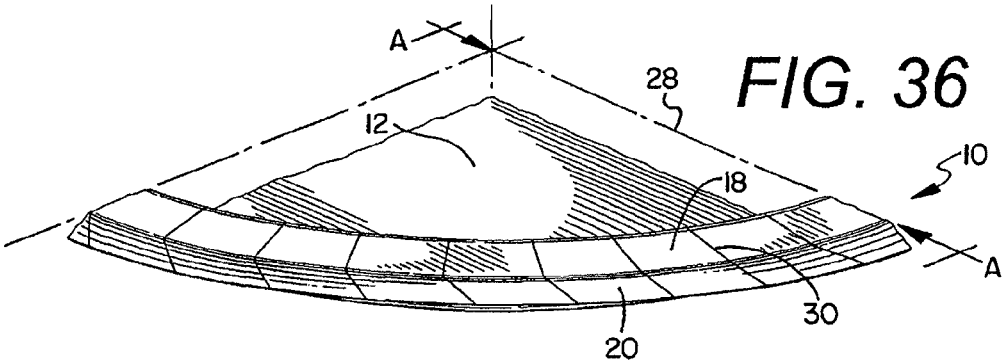
FIG. 36 is an elevated perspective view of that which is shown in FIG. 35, shown from an opposite side.
Figure 37:
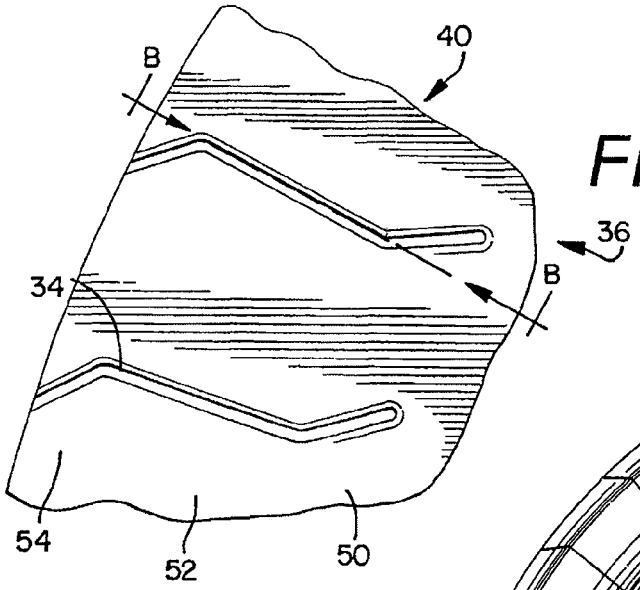
FIG. 37 is a top plan view of a segment of the outer peripheral area of a paperboard blank for use in manufacturing the container shown in FIG. 35.
Figure 38:
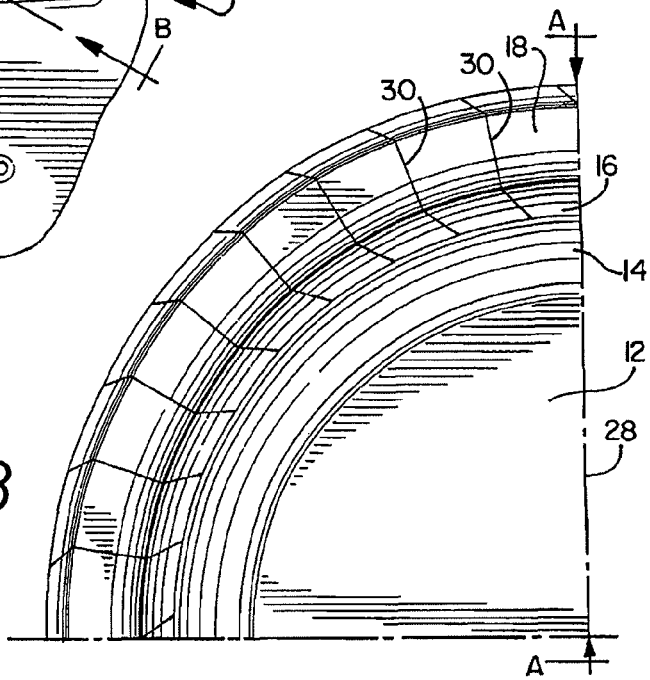
FIG. 38 is a top plan view of that which is shown in FIGS. 35 and 36.
Figure 39:
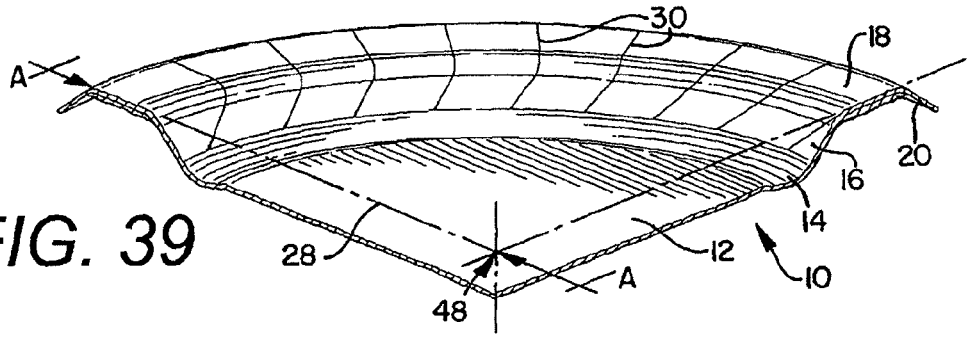
FIG. 39 is an elevated perspective view of a quartered section of a container according to an alternative embodiment of the invention, having scores formed along a segmented lineal path that is generally S-shaped.
Figure 40:
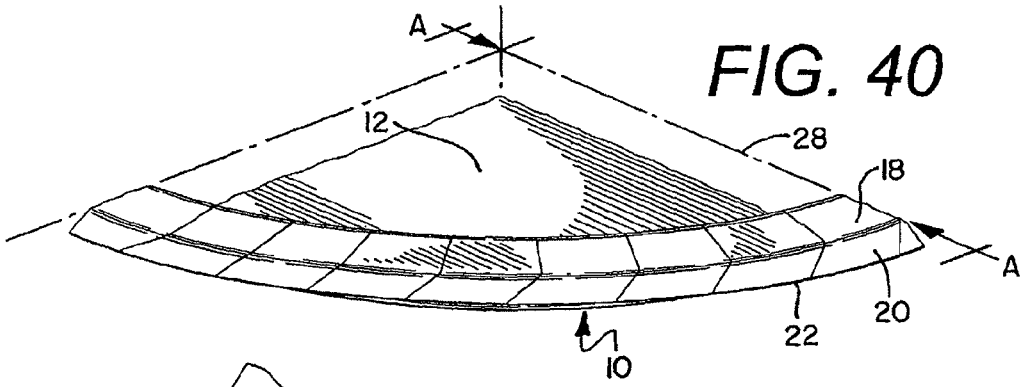
FIG. 40 is an elevated perspective view of that which is shown in FIG. 39, shown from an opposite side.
Figure 41:
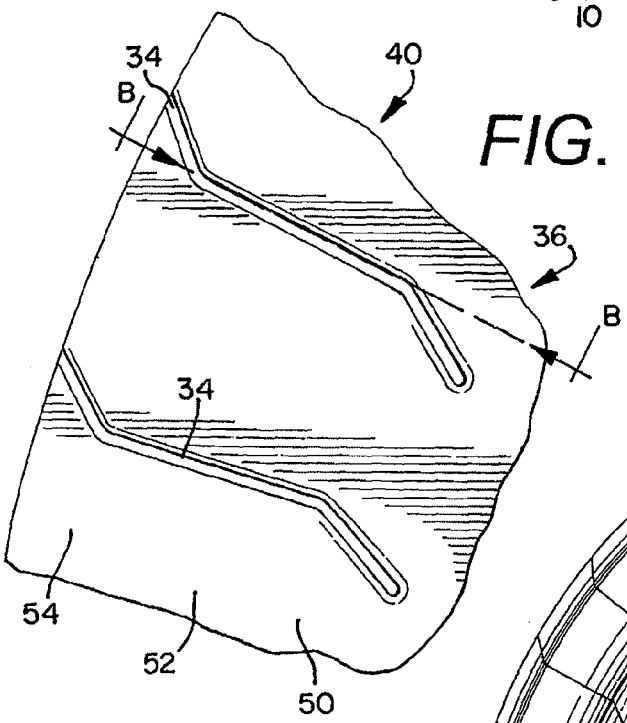
FIG. 41 is a top plan view of a segment of the outer peripheral area of a paperboard blank for use in manufacturing the container shown in FIG. 39.
Figure 42:
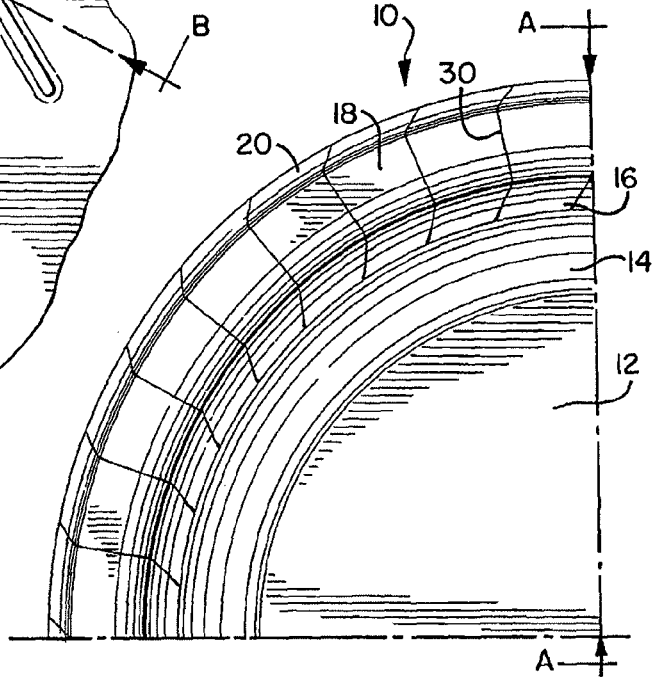
FIG. 42 is a top plan view of that which is shown in FIGS. 39 and 40.
Figure 43:
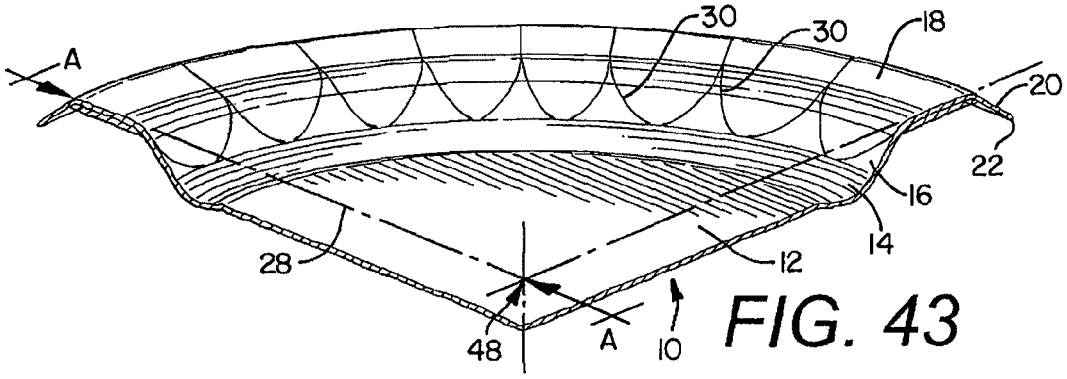
FIG. 43 is an elevated perspective view of a quartered section of a container according to an alternative embodiment of the invention, having scores with a converging segment, a radially extending linear segment, and a non-radially extending linear segment at the outermost region of the container.
Figure 44:
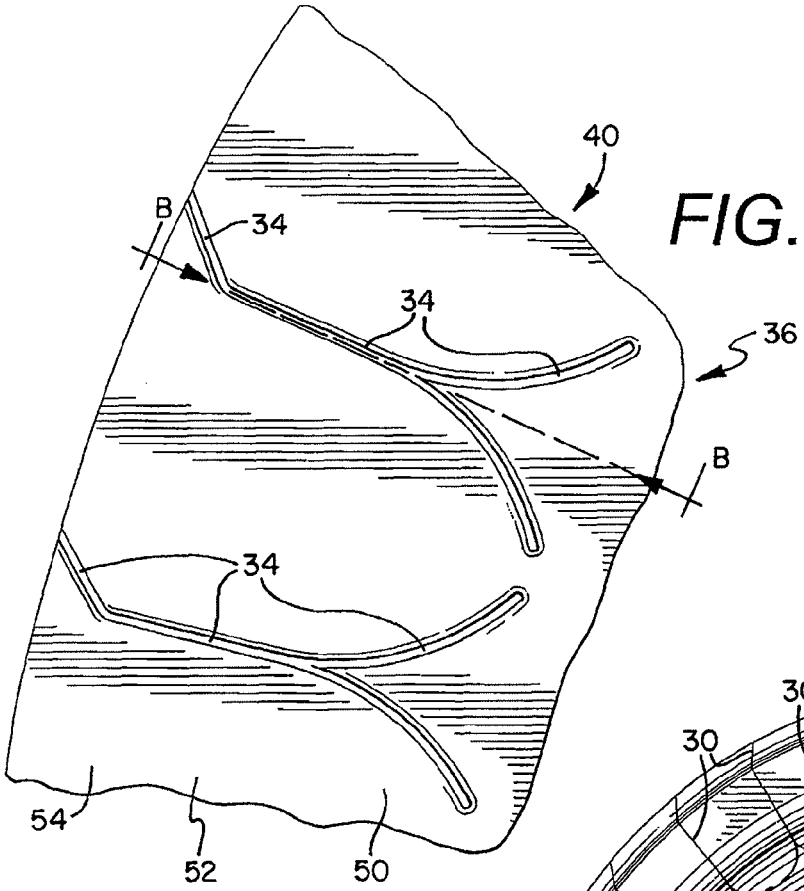
FIG. 44 is a top plan view of a segment of the outer peripheral area of a paperboard blank for use in manufacturing the container shown in FIG. 43; and, FIG. 45 is a top plan view of that which is shown in FIG. 43.
Figure 45:
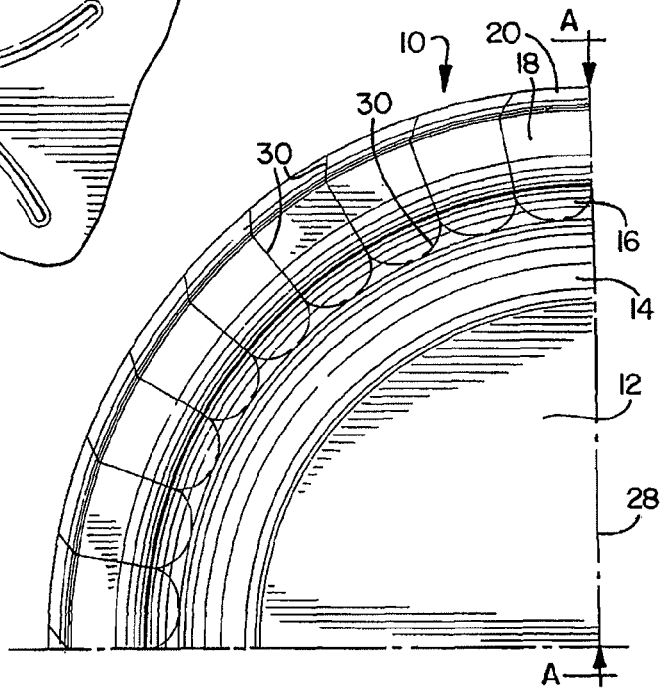

FIGS. 20-22 show an embodiment wherein the scores 34 of the blank 36, and resulting pleats 30 of the container 10, are linear and extend non-radially. Thus, the evenly-spaced linear scores 34 differ from prior art methods in that the score 34 does not reside along a radial line B-B of the blank 36. Consequently, the pleats 30 also do not reside along a radial line A-A of the curvature of the finished container 10. Similarly, FIGS. 23-26 and 35-42 shown an embodiment wherein at least a portion of the score 34 and resulting pleat 30 extends along a path transverse to the radial line A-A and B-B. These embodiments therefore provide the benefits of forming non-radially-extending pleats 30 of the resulting container 10, while optimizing the arrangement of paperboard pleat formation for a particular geometry of the container. For example, having a linear segment of the score 34 in the mid-region 52 of the blank outer area 40 may be preferred for plates 10 with a flat rim 16, whereby the paperboard gathering may not greatly vary along the extent of the pleat 30. FIGS. 43-45 show an embodiment in which a similar lineal segment of the score 34, and resulting pleat 30, is located in the mid-region 52 of the blank 36 outer area 40, forming a lineal pleat 30 segment in the rim 16 area of the container 10. However, each of these embodiments include forming a finished container with an extent of the pleat 30 that is non-radial.

FIGS. 31-34 show an alternate embodiment in which the score 34 has an S-shaped curvilinear profile. The pleat 30 thereby formed in the container 10 has a similar generally S-shaped configuration along the length, such that the pleat 30 is non-linear and does not extend along a radial line of the container 10. In this manner, the embodiments of FIGS. 35-42, although having pleats 30 (and scores 34 of the blank 36 used to manufacture the container 10) that appear as joined linear segment, similarly form a generally S-shaped configuration along the extent of the pleat 30. Such curvature, or joined transverse lineal segments, provide added resistance from pleat failure due to paperboard layers separating.

Each alternate embodiment, shown in the Figures, utilize score/pleat arrangements which may be varied in angular displacement from the container axis A-A and blank axis B-B, while still enjoying the benefits of the invention. Such pleat arrangements (and score arrangements) may also be altered with regard to the curvature of curved segments, such as to increase the radius of curvature of the pleat relative to what is shown in the Figures Further, the number of scores 34 may vary based upon the amount of paperboard gathering necessary to form the depth D of the container 10, while still keeping with the method and article of the invention.

One potential reason for altering the score geometry, as shown in the Figures, is to adjust the score in accordance with differences in geometry of the formed paperboard container. For example, when using the plate geometry shown in FIGS. 43-45, in which the rim 18 is flat rather than rounded, the gathering of paperboard material in the rim will likely be more constant along the extent of the rim 18 as compared to the amount of material gathering in the sidewall. The objective, therefore, is to utilize the proper score arrangement to provide an extent of score the does not reside along a radial line, and which includes the proper shape and frequency of scores in each region of the peripheral area to optimize paperboard material gathering during the plate forming process. As depicted in Figures of the blank 36, the outer peripheral area 40 of each shown paperboard blank 36 has at least three distinct regions 50, 52, 54. The inner-most region 50 is the area of the blank that will be formed as at least part of the sidewall 16, and the radius of curvature of the container bottom, of the finished container, whether it is a plate or a bowl or the like. Depending on the slope and height of the sidewall 16, this inner-most area 50 may have a sharply increasing amount of material gathering, and thus a different score arrangement may be desired. The adjacent (middle) region 52 of the periphery 40 is the area that forms the rim 18 region of the finished container 10. Depending upon the shape of the rim 18 (i.e., curved or flat) this region 52 may have a different score arrangement or different number of score areas relative other regions of the peripheral area 40. Lastly, the outer-most region 54 of the peripheral area 40, which is generally the area associated with the outer lip 20 of the container, may have its own distinct requirements for a different score arrangement, and may be benefited by having a directional change of the score path, such as is shown in alternative embodiments the Figures and explained herein.

In addition to adding rigidity and strength to the finished container (as a plate or bowl), the non-linear and/or non-radial pleats 30, and associated with non-linear and/or non-radial scores 34, may also enhance the decorative appearance of the plate. Because pleat shapes have traditionally been radial and linear, the use of non-radial and non-linear pleats gives designers freedom to create a variety of unique and distinctive designs. Also, variation of the pleat geometry and frequency provides proper paperboard gathering in non-round container designs.

Another example of such possible use of non-linear and/or non-radial scores and pleats is the manufacture of paperboard trays, such as a generally-rectangular tray shape or some other such drawn shape that has rounded regions and/or rounded corners. Similar to the plates shown herein, pleats 30 of such drawn rounded regions may be arranged in a pattern whereby at least an extent of the pleat 30 is non-radial relative a radial axis 28 of the rounded region. Stated another way, a container 10 with a curvilinear path of the bottom wall 12, and thus a curvilinear path of the sidewall 16, will require pleats 30 in that area of the sidewall 16 and/or rim 18, depending upon the radius of curvature of the curvilinear path. Thus, such pleats should have at least an extent of length that does not reside on a radial line passing from the origin 48 of the radius and transecting the curved region. Similarly, such an alternative container, such as a tray, may include a plurality of pleats 30 in the rounded region of the eventual container have a non-linear configuration.

While the specific embodiments have been illustrated and described, numerous modifications come to mind without significantly departing from the spirit of the invention, and the scope of protection is only limited by the scope of the accompanying Claims.

What is claimed is:

1. A paperboard container comprising:

a substantially round body of paperboard having a characteristic diameter with a bottom wall and a sidewall extending upward from the bottom wall;

a rim extending outward from the sidewall; and pleats of folded paperboard material formed along score lines of the paperboard, each pleat extending outwardly through a portion of the sidewall and a portion of the rim along a pleat length, wherein a plurality of the pleats have a pleat length with a non-linear extent that does not reside along any radial line passing though the center of said substantially round body.

2. The container of claim 1 wherein said non-linear extent of said plurality of pleats resides in at least a portion of the rim.

3. The container of claim 1, wherein said non-linear extent of said plurality of pleats resides in at least a portion of the sidewall.

4. The container of claim 1, wherein said non-linear extent of said plurality of pleats resides in at least a portion of the lip.

5. The container of claim 1, wherein said non-linear extent of each of said plurality of pleats includes a curvilinear segment of said pleat length.

6. The container of claim 1, wherein said non-linear extent of each of said plurality of pleats includes lineal segments of the length of the pleat, each said lineal segment being sequentially positioned along the pleat length wherein at least a portion of said length extends along a path transverse to the radial line positioned on a radially-extending axis of the container.

7. The container of claim 1, wherein an extent of each said pleat length being curvilinear.

8. The container of claim 7, wherein the curvilinear extent of each said pleat includes an arcuate portion of the pleat.

9. The container of claim 8, wherein the arcuate portion of each said pleat is formed by scoring paperboard in the region of the rim, such that an arcuate shaped length of score is created in the paperboard and each said pleat resides along one of said arcuate shaped length of the score.

10. The container of claim 1, comprising a plate having a characteristic outermost diameter in the range of 5 to 10 inches and wherein said non-linear extent of each said pleat is configured to reside along a pleat path independent from that of other said pleats.

11. The container of claim 1, wherein the non-linear extent of said pleat resides in at least the rim and a linear segment of the pleat resides in the lip.

12. The container of claim 11, wherein said non-linear extent of the pleat is arcuate.

13. The container of claim 11, wherein the linear segment of each of said plurality of pleats in the lip resides along radial axis of said container.

14. A paperboard container comprising:

a substantially round body having a characteristic diameter with a bottom wall and a sidewall extending upward from the bottom wall;

a rim extending outward from the sidewall; and pleats of folded paperboard material formed along score lines of the paperboard, each pleat extending outwardly through a portion of the sidewall and a portion of the rim, wherein at least a plurality of said pleats each have a respective pleat path in relation to an adjacent radial line defined by a linear cross-sectional axis of the outermost diameter of the container, and wherein at least a portion of said pleat path has a non-radial extent that does not reside along the radial line.

15. The container of claim 14 wherein said non-radial extent of each of said pleats extends through at least a portion of the rim.

16. The container of claim 14, wherein said non-radial extent of each of said pleats extends through at least a portion of the sidewall.

17. The container of claim 14, wherein said non-radial extent of each of said pleats extends through at least a portion of the lip.

18. The container of claim 14, wherein said non-radial extent of each of said pleats includes a segment of the pleat that is curvilinear in relation to a radial line along said linear cross-sectional axis of the container.

19. The container of claim 14, wherein said non-radial extent of each of said pleats includes lineal segments of the length of the pleat, each said lineal segment being sequentially positioned along the pleat length and wherein at least a portion of said length resides transverse to said radial line.

20. The container of claim 14, wherein an extent of each of said pleats is curvilinear in relation to the radial line defined by said linear cross-sectional axis.

21. The container of claim 20, wherein the curvilinear extent of each said pleat is arcuate in relation to the radial line defined by said linear cross-sectional axis.

22. The container of claim 21, wherein the curvilinear extent of each of said plurality of pleats is formed by scoring the paperboard in an outer region of a substantially flat paperboard blank used to form said container, such that an arcuate path of score is formed as an arcuate line of delaminated paperboard, such that said pleats form along said score when the container is formed from said blank.

23. The container of claim 14, comprising a plate having said diameter in the range of 5 to 10 inches and wherein said non-radial extent of each of said pleats is configured to reside along a pleat path independent from that of other said pleats.

24. The container of claim 14, wherein the non-radial extent of each of said pleats resides in at least the rim, and a radial segment of each of said pleats resides in the lip.

25. The container of claim 24, wherein said non-radial extent of each of said pleats is arcuate.

26. The container of claim 24, wherein the non-radial extent of each of said pleats includes an extent that is generally S-shaped.

27. The container of claim 26, wherein the generally S-shaped extent is formed as a curvilinear score along its entire extent.

28. The container of claim 26, wherein the generally S-shaped extent of each pleat is formed as linear segments positioned in sequential order along at least a portion of the pleat length.

29. A paperboard container formed of a paperboard blank, comprising:

a generally cupped body having a generally flat bottom wall surrounded by an upturned sidewall that extends angularly upward of the bottom wall toward a rim that surrounds at least a portion of the sidewall, said generally cupped body having a central radius focus and wherein radial axis lines extend between the central radius focus and transect the rim of the container;

an arrangement of pleats residing in said outer portion of the sidewall, each said pleat being formed by folded layers of paperboard material and having a pleat path along a pleat length of the paperboard, at least a plurality of said pleats each having a non-radial extent of outwardly extending pleat path that does not reside along any radial axis line of the container.

30. The container of claim 29, wherein said non-radial extent of each of said pleats extends through an upper portion of the sidewall.

31. The container of claim 29 wherein said non-radial extent of each of said pleats extends through at least a portion of the rim.

32. The container of claim 29, wherein said non-radial extent of each of said pleats includes a curvilinear segment of the pleat.

33. The container of claim 29 wherein said non-radial extent of each of said pleats includes lineal segments of a length of the pleat, each said lineal segment being sequentially positioned along the pleat length.

34. The container of claim 33, wherein the non-radial extent of each of said pleats is an arcuate segment of said pleat length in relation to said radial axis line of the container.

35. The container of claim 29, wherein the non-radial extent of each of said pleats is formed by scoring the paperboard in an outer region of a substantially flat circular blank of paperboard, such that said pleats form along said score when the container is formed from said blank.

36. The container of claim 29 wherein the container is generally round.

37. The container of claim 36 wherein the container is a plate.

38. A method of manufacturing a paperboard container comprising the steps of:

forming a substantially flat paperboard blank with scores spaced about a peripheral region of the blank, wherein a plurality of the scores have a non-linear extent along an outwardly extending length of the score that does not reside along any radial line passing though the center of said blank; and, forming the blank into a dish-shaped paperboard container having a plurality of pleats, each pleat formed by gathering paperboard material that is folded such that at least a portion of the pleat contains at least a double layer of paperboard along a respective score and at least a plurality of the pleats are formed along the scores such that the pleats have a non-radial extent that does not reside along any radially extending axis through the center of the container.

39. The method of claim 38, wherein the non-radial extent of each of said scores includes a curvilinear portion of the score length in relation to the radially extending axis.

40. The method of claim 39, wherein at least an extent of the curvilinear portion of each of said score is arcuate in relation to the radially extending axis.

41. The method of claim 38, wherein all of the scores formed about the peripheral region of the blank each have an extent that is arcuate along a length of the score in relation to the radially extending axis.

42. The method of claim 38 wherein at least a portion of the non-radial extent of each of said scores includes a linear segment that resides transverse to said radial line of the blank.

43. The method of claim 38 wherein the paperboard container is generally round and said radial line resides on a cross sectional axis of the characteristic diameter of the generally round shape.

44. The method of claim 38 wherein the paperboard container is a plate.

45. The method of claim 44 wherein the scores are substantially evenly spaced about the peripheral area of the entire circumference of the round blank and wherein each of said pleats has an extent that transects a respective radial axis line of the blank.

* * * * *